US009017114B2

(12) United States Patent
Cohen et al.

(10) Patent No.: US 9,017,114 B2
(45) Date of Patent: Apr. 28, 2015

(54) MATING CONTACTS FOR HIGH SPEED ELECTRICAL CONNECTORS

(71) Applicant: Amphenol Corporation, Wallingford Center, CT (US)

(72) Inventors: Thomas S. Cohen, New Boston, NH (US); Trent K. Do, Nashua, NH (US); Brian Kirk, Amherst, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

(21) Appl. No.: 14/014,019

(22) Filed: Aug. 29, 2013

(65) Prior Publication Data

US 2014/0065883 A1 Mar. 6, 2014

Related U.S. Application Data

(63) Continuation of application No. 12/878,799, filed on Sep. 9, 2010, now Pat. No. 8,550,861.

(60) Provisional application No. 61/240,890, filed on Sep. 9, 2009, provisional application No. 61/289,785, filed on Dec. 23, 2009.

(51) Int. Cl.
*H01R 11/22* (2006.01)
*H01R 12/58* (2011.01)

(Continued)

(52) U.S. Cl.
CPC ..... *H01R 13/658* (2013.01); *H01R 12/58* (2013.01); *H01R 12/72* (2013.01); *H01R 13/28* (2013.01);

(Continued)

(58) Field of Classification Search
USPC ..... 439/607.05, 858, 861, 59, 682
See application file for complete search history.

(56) References Cited

U.S. PATENT DOCUMENTS 3,262,082 A 7/1966 Gammel, Sr.
3,582,867 A 6/1971 Thompson et al.

(Continued)

FOREIGN PATENT DOCUMENTS

CN 101124697 A 2/2008
EP 1427061 A2 6/2004

(Continued)

OTHER PUBLICATIONS

High Speed Backplane Connectors, Z-Pack-HM-Zd Connector, Catalog 1773095, retrieved from <www.tycoelectronics.com>, Rev. Dec. 2008, pp. 56-94.

(Continued)

*Primary Examiner* — Hien Vu
(74) *Attorney, Agent, or Firm* — Wolf, Greenfield & Sacks, P.C.

(57) ABSTRACT

An electrical interconnection system with high speed, high density electrical connectors. One of the connectors includes a mating contact portion that generates contact force as it is compressed against a wall of the connector housing. The mating contact portion has multiple segments, each with a contact region extending from the wall, such that multiple points of contact to a complementary mating contact portion in a mating connector are provided for mechanical robustness. Additionally, each signal path through the mating interface portions of the connectors can be narrow and has a relatively uniform cross section to provide a uniform impedance. Additional size reduction may be achieved by mounting a ground contact on an exterior surface of a connector housing in alternating rows. Additionally, embodiments in which a wavy contact is used in a cantilevered configuration are also described.

24 Claims, 22 Drawing Sheets

(51) Int. Cl.

| | |
|---|---|
| ***H01R 12/72*** | (2011.01) |
| ***H01R 13/28*** | (2006.01) |
| ***H01R 13/6471*** | (2011.01) |
| ***H01R 13/658*** | (2011.01) |
| ***H01R 12/50*** | (2011.01) |
| ***H01R 43/00*** | (2006.01) |

(52) U.S. Cl.

CPC ..... *H01R 13/6471* (2013.01); *H01R 23/688* (2013.01); *H01R 43/00* (2013.01); *Y10T 29/49174* (2015.01); *Y10T 29/49208* (2015.01)

(56) References Cited

U.S. PATENT DOCUMENTS

| | | | | |
|---|---|---|---|---|
| 4,002,400 | A | 1/1977 | Evans | |
| 4,036,544 | A * | 7/1977 | Keglewitsch | 439/350 |
| 4,052,688 | A | 10/1977 | DeNigris et al. | |
| 4,175,821 | A | 11/1979 | Hunter | |
| 4,519,665 | A | 5/1985 | Althouse et al. | |
| 4,519,667 | A | 5/1985 | Canning et al. | |
| 4,607,907 | A | 8/1986 | Bogursky | |
| 4,786,258 | A | 11/1988 | Shaffer et al. | |
| 4,790,763 | A | 12/1988 | Weber et al. | |
| 4,795,379 | A | 1/1989 | Sasaki et al. | |
| 4,812,133 | A | 3/1989 | Fleak et al. | |
| 4,820,169 | A | 4/1989 | Weber et al. | |
| 4,826,443 | A | 5/1989 | Lockard | |
| 4,846,727 | A | 7/1989 | Glover et al. | |
| 4,867,597 | A | 9/1989 | Denlinger et al. | |
| 4,871,316 | A | 10/1989 | Herrell et al. | |
| 4,895,535 | A | 1/1990 | Emadi et al. | |
| 4,932,885 | A | 6/1990 | Scholz | |
| 4,934,950 | A | 6/1990 | Green et al. | |
| 5,009,606 | A | 4/1991 | Villeneuve et al. | |
| 5,024,605 | A | 6/1991 | Kasatani et al. | |
| 5,041,023 | A | 8/1991 | Lytle | |
| 5,051,099 | A | 9/1991 | Pickles et al. | |
| 5,062,809 | A | 11/1991 | Sakamoto et al. | |
| 5,080,613 | A | 1/1992 | Orui et al. | |
| 5,096,443 | A | 3/1992 | Myrick et al. | |
| 5,173,063 | A | 12/1992 | Barkus et al. | |
| 5,199,884 | A | 4/1993 | Kaufman et al. | |
| 5,211,585 | A | 5/1993 | Douty et al. | |
| 5,219,301 | A | 6/1993 | Frantz | |
| 5,346,410 | A | 9/1994 | Moore, Jr. | |
| 5,370,557 | A | 12/1994 | Olsson | |
| 5,645,459 | A * | 7/1997 | Fitting | 439/857 |
| 5,919,049 | A | 7/1999 | Petersen et al. | |
| 5,993,259 | A | 11/1999 | Stokoe et al. | |
| 6,024,579 | A | 2/2000 | Bennett | |
| 6,059,600 | A | 5/2000 | Vanbesien | |
| 6,109,949 | A | 8/2000 | Suzuki et al. | |
| 6,171,115 | B1 | 1/2001 | Mickievicz et al. | |
| 6,174,944 | B1 | 1/2001 | Chiba et al. | |
| 6,293,827 | B1 | 9/2001 | Stokoe | |
| 6,315,591 | B2 | 11/2001 | Oda et al. | |
| 6,315,621 | B1 | 11/2001 | Natori et al. | |
| 6,347,962 | B1 | 2/2002 | Kline | |
| 6,350,134 | B1 | 2/2002 | Fogg et al. | |
| 6,379,188 | B1 | 4/2002 | Cohen et al. | |
| 6,409,543 | B1 | 6/2002 | Astbury, Jr. et al. | |
| 6,454,603 | B2 | 9/2002 | Casey et al. | |
| 6,503,103 | B1 | 1/2003 | Cohen et al. | |
| 6,506,076 | B2 | 1/2003 | Cohen et al. | |
| 6,540,526 | B2 | 4/2003 | Toda | |
| 6,540,559 | B1 | 4/2003 | Kemmick et al. | |
| 6,554,647 | B1 | 4/2003 | Cohen et al. | |
| 6,565,387 | B2 * | 5/2003 | Cohen | 439/607.06 |
| 6,592,381 | B2 | 7/2003 | Cohen et al. | |
| 6,602,095 | B2 | 8/2003 | Astbury, Jr. et al. | |
| 6,607,402 | B2 | 8/2003 | Cohen et al. | |
| 6,641,420 | B2 | 11/2003 | Blanchfield et al. | |
| 6,645,012 | B2 | 11/2003 | Ito et al. | |
| 6,652,319 | B1 | 11/2003 | Billman | |
| 6,655,966 | B2 | 12/2003 | Rothermel et al. | |
| 6,709,294 | B1 | 3/2004 | Cohen et al. | |
| 6,764,349 | B2 | 7/2004 | Provencher et al. | |
| 6,776,659 | B1 | 8/2004 | Stokoe et al. | |
| 6,786,771 | B2 | 9/2004 | Gailus | |
| 6,808,420 | B2 | 10/2004 | Whiteman, Jr. et al. | |
| 6,811,440 | B1 | 11/2004 | Rothermel et al. | |
| 6,824,391 | B2 | 11/2004 | Mickievicz et al. | |
| 6,827,611 | B1 | 12/2004 | Payne et al. | |
| 6,866,549 | B2 | 3/2005 | Kimura et al. | |
| 6,872,085 | B1 | 3/2005 | Cohen et al. | |
| 6,875,031 | B1 | 4/2005 | Korsunsky et al. | |
| 6,899,548 | B2 | 5/2005 | Houtz | |
| 6,932,649 | B1 | 8/2005 | Rothermel et al. | |
| 6,942,509 | B2 | 9/2005 | Sasame et al. | |
| 6,945,810 | B1 | 9/2005 | Morana et al. | |
| 6,979,202 | B2 | 12/2005 | Benham et al. | |
| 7,008,250 | B2 | 3/2006 | Shuey et al. | |
| 7,044,794 | B2 | 5/2006 | Consoli et al. | |
| 7,163,421 | B1 | 1/2007 | Cohen et al. | |
| 7,175,445 | B2 | 2/2007 | Consoli et al. | |
| 7,182,616 | B2 | 2/2007 | Shuey et al. | |
| 7,186,121 | B1 | 3/2007 | Costello et al. | |
| 7,316,585 | B2 | 1/2008 | Smith et al. | |
| 7,326,092 | B2 | 2/2008 | Fedder et al. | |
| 7,335,063 | B2 | 2/2008 | Cohen et al. | |
| 7,371,117 | B2 | 5/2008 | Gailus | |
| 7,494,383 | B2 | 2/2009 | Cohen et al. | |
| 7,503,804 | B2 | 3/2009 | Minich | |
| 7,517,250 | B2 | 4/2009 | Hull et al. | |
| 7,544,096 | B2 | 6/2009 | Cohen et al. | |
| 7,581,990 | B2 | 9/2009 | Kirk et al. | |
| 7,775,822 | B2 | 8/2010 | Ngo et al. | |
| 7,794,278 | B2 | 9/2010 | Cohen et al. | |
| 7,811,130 | B2 | 10/2010 | Cohen et al. | |
| 7,874,873 | B2 | 1/2011 | Do et al. | |
| 7,914,304 | B2 | 3/2011 | Cartier et al. | |
| 7,950,963 | B2 * | 5/2011 | Mizukami et al. | 439/607.07 |
| 7,985,097 | B2 | 7/2011 | Gulla | |
| 8,062,046 | B2 | 11/2011 | Daily et al. | |
| 8,469,720 | B2 | 6/2013 | Gulla | |
| 8,550,861 | B2 | 10/2013 | Cohen et al. | |
| 8,727,791 | B2 | 5/2014 | Gulla | |
| 2001/0012730 | A1 | 8/2001 | Ramey et al. | |
| 2001/0044235 | A1 | 11/2001 | Cohen | |
| 2001/0046810 | A1 | 11/2001 | Cohen et al. | |
| 2002/0098738 | A1 | 7/2002 | Astbury, et al. | |
| 2002/0111069 | A1 | 8/2002 | Astbury, et al. | |
| 2002/0123266 | A1 | 9/2002 | Ramey et al. | |
| 2002/0142675 | A1 | 10/2002 | Billman | |
| 2003/0220018 | A1 | 11/2003 | Winings et al. | |
| 2004/0171305 | A1 | 9/2004 | McGowan et al. | |
| 2004/0235352 | A1 | 11/2004 | Takemasa | |
| 2005/0048838 | A1 | 3/2005 | Korsunsky et al. | |
| 2005/0048842 | A1 | 3/2005 | Benham et al. | |
| 2005/0176835 | A1 | 8/2005 | Kobayashi et al. | |
| 2005/0266728 | A1 | 12/2005 | Houtz | |
| 2006/0003620 | A1 | 1/2006 | Daily et al. | |
| 2006/0068640 | A1 | 3/2006 | Gailus | |
| 2006/0128203 | A1 | 6/2006 | Yosler | |
| 2006/0292932 | A1 | 12/2006 | Benham et al. | |
| 2007/0004282 | A1 | 1/2007 | Cohen et al. | |
| 2007/0021000 | A1 | 1/2007 | Laurx | |
| 2007/0021001 | A1 | 1/2007 | Laurx et al. | |
| 2007/0021002 | A1 | 1/2007 | Laurx et al. | |
| 2007/0021003 | A1 | 1/2007 | Laurx et al. | |
| 2007/0021004 | A1 | 1/2007 | Laurx et al. | |
| 2007/0037434 | A1 | 2/2007 | Fedder et al. | |
| 2007/0042639 | A1 | 2/2007 | Manter et al. | |
| 2008/0194146 | A1 | 8/2008 | Gailus | |
| 2008/0214055 | A1 | 9/2008 | Gulla | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2009/0011641 | A1 | 1/2009 | Cohen et al. | |

(56) References Cited

U.S. PATENT DOCUMENTS

| | | | |
|---|---|---|---|
| 2009/0239395 | A1 | 9/2009 | Cohen et al. |
| 2014/0065883 | A1 | 3/2014 | Cohen et al. |

FOREIGN PATENT DOCUMENTS

| | | | |
|---|---|---|---|
| WO | 01/57961 | A1 | 8/2001 |
| WO | 2008/124052 | A2 | 10/2008 |
| WO | 2008/124054 | A2 | 10/2008 |
| WO | 2008/124057 | A2 | 10/2008 |
| WO | 2008/124101 | A2 | 10/2008 |

OTHER PUBLICATIONS

International Search Report and Written Opinion for International Application No. PCT/US2010/002452 mailed Mar. 29, 2011.
International Preliminary Report on Patentability for International Application No. PCT/US2010/002452 mailed Mar. 22, 2012.
International Search Report and Written Opinion mailed Oct. 16, 2008 from International Application No. PCT/US2007/026056.
International Preliminary Report on Patentability of the International Searching Authority mailed Jul. 2, 2009 from International Application No. PCT/US2007/026056.
International Search Report and Written Opinion mailed Jul. 14, 2009 from International Application No. PCT/US2009/000316.

* cited by examiner

MATING CONTACTS FOR HIGH SPEED ELECTRICAL CONNECTORS

RELATED APPLICATIONS

This application is a continuation of application Ser. No. 12/878,799, filed on Sep. 9, 2010, which claims priority under 35 U.S.C. §119(e) to U.S. Provisional Application Ser. No. 61/240,890, entitled "COMPRESSIVE CONTACT FOR HIGH SPEED ELECTRICAL CONNECTOR" filed on Sep. 9, 2009, and to U.S. Provisional Application Ser. No. 61/289,785, entitled "COMPRESSIVE CONTACT FOR HIGH SPEED ELECTRICAL CONNECTOR" filed on Dec. 23, 2009, each of which is incorporated herein by reference in its entirety.

BACKGROUND OF INVENTION

1. Field of Invention

This invention relates generally to electrical interconnection systems and more specifically to high density, high speed electrical connectors.

2. Discussion of Related Art

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

One of the difficulties in making a high density, high speed connector is that electrical conductors in the connector can be so close that there can be electrical interference between adjacent signal conductors. To reduce interference, and to otherwise provide desirable electrical properties, shield members are often placed between or around adjacent signal conductors. The shields prevent signals carried on one conductor from creating "crosstalk" on another conductor. The shield also impacts the impedance of each conductor, which can further contribute to desirable electrical properties. Shields can be in the form of grounded metal structures or may be in the form of electrically lossy material.

Other techniques may be used to control the performance of a connector. Transmitting signals differentially can also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals.

Maintaining signal integrity can be a particular challenge in the mating interface of the connector. At the mating interface, force must be generated to press conductive elements from the separable connectors together so that a reliable electrical connection is made between the two conductive elements. Frequently, this force is generated by spring characteristics of the mating contact portions in one of the connectors. For example, the mating contact portions of one connector may contain one or more members shaped as beams. As the connectors are pressed together, these beams are deflected by a mating contact portion, shaped as a post or pin, in the other connector. The spring force generated by the beam as it is deflected provides a contact force.

For mechanical reliability, many contacts have multiple beams. In some instances, the beams are opposing, pressing on opposite sides of a mating contact portion of a conductive element from another connector. The beams may alternatively be parallel, pressing on the same side of a mating contact portion.

Regardless of the specific contact structure, the need to generate mechanical force imposes requirements on the shape of the mating contact portions. For example, the mating contact portions must be large enough to generate sufficient force to make a reliable electrical connection.

These mechanical requirements may preclude the use of shielding or may dictate the use of conductive material in places that alters the impedance of the conductive elements in the vicinity of the mating interface. Because abrupt changes in the impedance of a signal conductor can alter the signal integrity of that conductor, the mating contact portions are often accepted as being the noisy portion of the connector.

BRIEF DESCRIPTION OF DRAWINGS

The accompanying drawings are not intended to be drawn to scale. In the drawings, each identical or nearly identical component that is illustrated in various FIG. is represented by a like numeral. For purposes of clarity, not every component may be labeled in every drawing. In the drawings.

DETAILED DESCRIPTION

Figure 1:
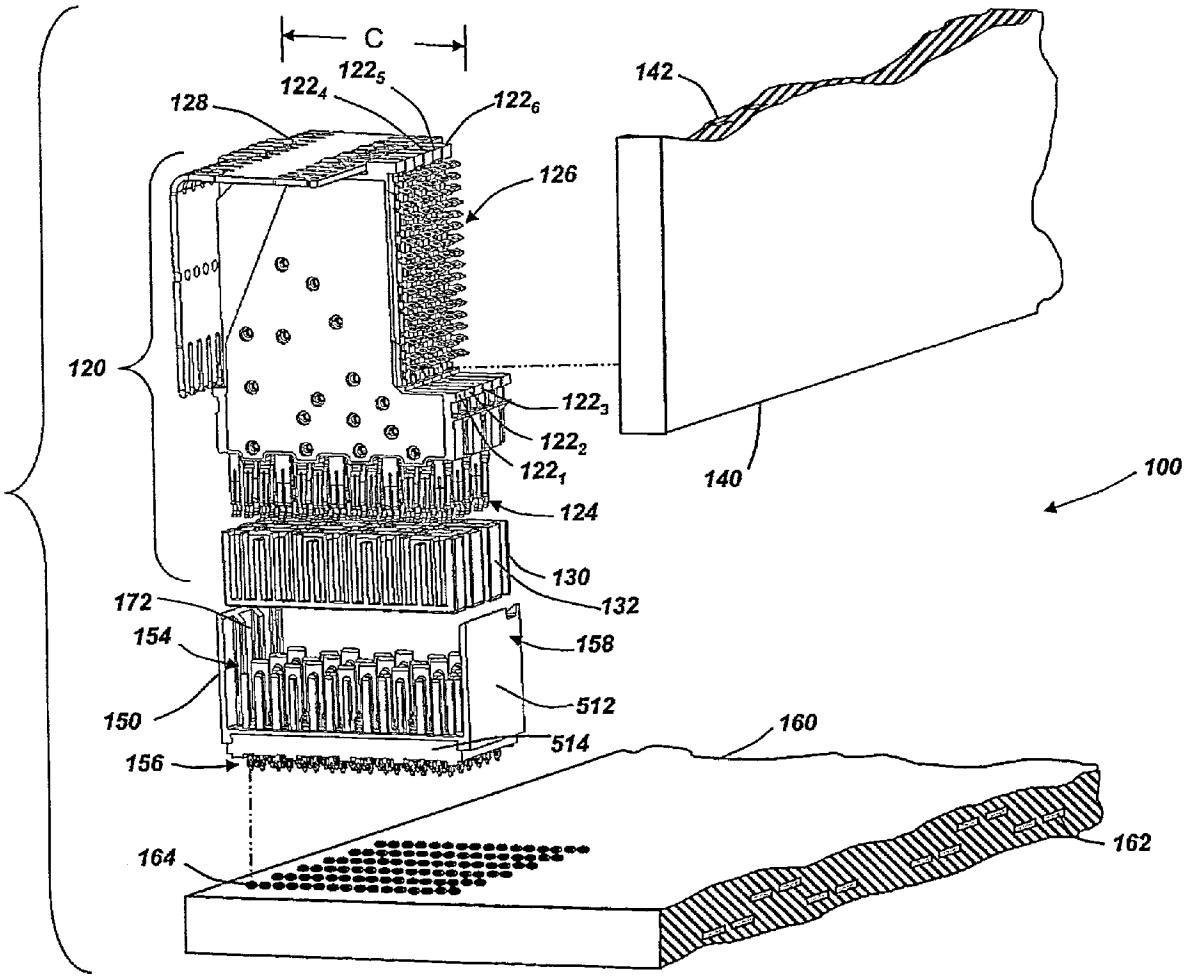
FIG. 1 is a perspective view of an electrical interconnection system illustrating an environment in which embodiments of the invention may be applied.

Referring to FIG. 1, an electrical interconnection system 100 with two connectors is shown. The electrical interconnection system 100 includes a daughter card connector 120 and a backplane connector 150.

Daughter card connector 120 is designed to mate with backplane connector 150, creating electronically conducting paths between backplane 160 and daughter card 140. Though not expressly shown, interconnection system 100 may interconnect multiple daughter cards having similar daughter card connectors that mate to similar backplane connections on backplane 160. Accordingly, the number and type of subassemblies connected through an interconnection system is not a limitation on the invention.

FIG. 1 illustrates an environment in which embodiments of the invention may be applied. Though FIG. 1 illustrates an interconnection system generally as is known in the art, conductive elements containing mating contact portions as described below may be substituted for some or all of the conductive elements illustrated in FIG. 1. As a result, an interconnection system according to some embodiments may incorporate electrical connectors that are more dense than connectors of conventional design.

In this example, the density of a connector refers to the number of conductive elements designed to carry a signal per unit length along an edge of daughter card 140. Accordingly, density may be increased by increasing the number of columns of signal conductors for unit length along the edge of daughter card 140. Alternatively or additionally, the density may be increased by increasing the number of conductive elements in each column. However, the length of each column cannot be arbitrarily increased because an interconnection system generally provides only limited space for a connector. For example, FIG. 1 shows a daughter card 140 mounted parallel to back plane 160. Though a single daughter card is shown, an interconnection system conventionally contains multiple daughter cards outlined in parallel on predefined pitch. The spacing between daughter cards sets a maximum length for each connector in the column direction C. Regardless of the approach used for increasing connector density, a higher density connector is likely to have more closely spaced contact elements that are smaller than in a lower density connector, creating challenges in the design of those contact elements to maintain desirable electrical and mechanical properties of the interconnection system. Design approaches for increasing connector density, while providing desirable electrical and mechanical properties, are described below.

FIG. 1 shows an interconnection system using a right-angle, backplane connector. It should be appreciated that in other embodiments, the electrical interconnection system 100 may include other types and combinations of connectors, as the invention may be broadly applied in many types of electrical connectors, such as right angle connectors, mezzanine connectors, card edge connectors and chip sockets.

Backplane connector 150 and daughter connector 120 each contains conductive elements. The conductive elements of daughter card connector 120 are coupled to traces, of which trace 142 is numbered, ground planes or other conductive elements within daughter card 140. The traces carry electrical signals and the ground planes provide reference levels for components on daughter card 140. Ground planes may have voltages that are at earth ground or positive or negative with respect to earth ground, as any voltage level may act as a reference level.

Similarly, conductive elements in backplane connector 150 are coupled to traces, of which trace 162 is numbered, ground planes or other conductive elements within backplane 160. When daughter card connector 120 and backplane connector 150 mate, conductive elements in the two connectors mate to complete electrically conductive paths between the conductive elements within backplane 160 and daughter card 140.

Figure 6C:
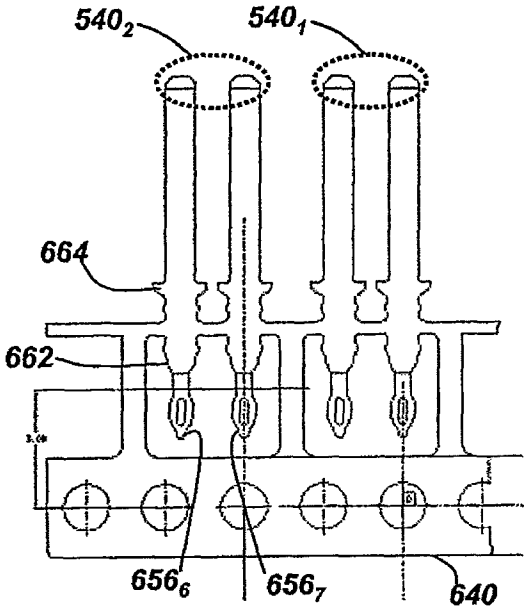
FIGS. 6A-6C are enlarged detail views of conductors used in the manufacture of a backplane connector of FIG. 5A.
Figure 6B:
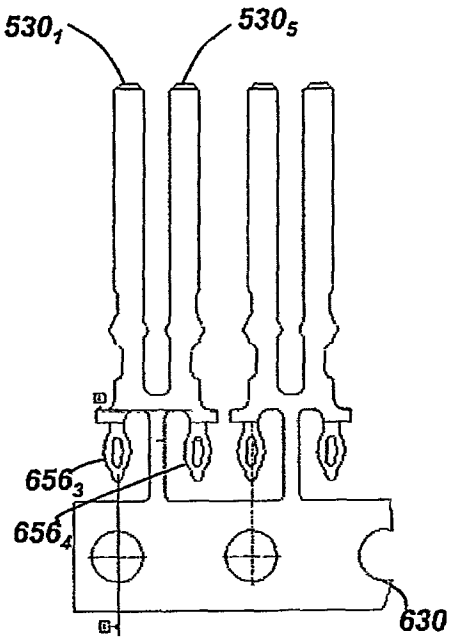
Figure 6A:
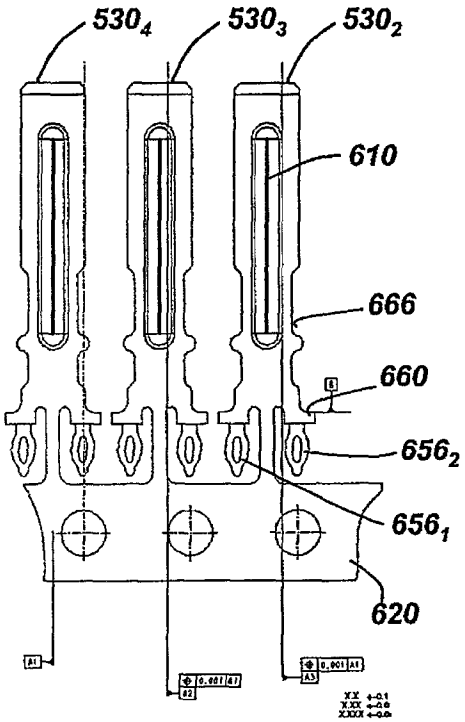

Backplane connector 150 includes a backplane shroud 158 and a plurality of conductive elements (see FIGS. 6A-6C). The conductive elements of backplane connector 150 extend through floor 514 of the backplane shroud 158 with portions both above and below floor 514. Here, the portions of the conductive elements that extend above floor 514 form mating contacts, shown collectively as mating contact portions 154, which are adapted to mate to corresponding conductive elements of daughter card connector 120. In the illustrated embodiment, mating contacts 154 are in the form of blades, although other suitable contact configurations may be employed, as the present invention is not limited in this regard.

Tail portions, shown collectively as contact tails 156, of the conductive elements extend below the shroud floor 514 and are adapted to be attached to backplane 160. Here, the tail portions are in the form of a press fit, "eye of the needle" compliant sections that fit within via holes, shown collectively as via holes 164, on backplane 160. However, other configurations are also suitable, such as surface mount elements, spring contacts, solderable pins, etc., as the present invention is not limited in this regard.

In the embodiment illustrated, backplane shroud 158 is molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to the invention. One or more fillers may be included in some or all of the binder material used to form backplane shroud 158 to control the electrical or mechanical properties of backplane shroud 150. For example, thermoplastic PPS filled to 30% by volume with glass fiber may be used to form shroud 158.

In the embodiment illustrated, backplane connector 150 is manufactured by molding backplane shroud 158 with openings to receive conductive elements. The conductive elements may be shaped with barbs or other retention features that hold the conductive elements in place when inserted in the opening of backplane shroud 158.

Figure 5A:
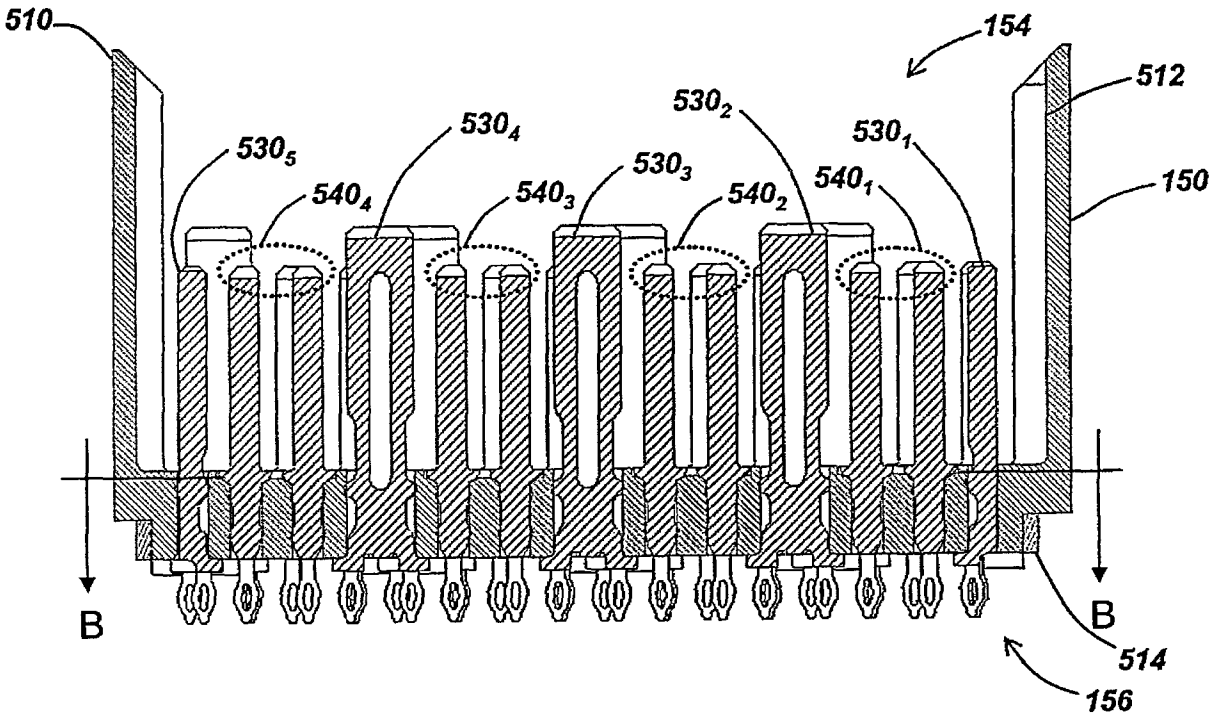
FIG. 5A is a cross-sectional representation of a backplane connector in the interconnection system of FIG. 1.

As shown in FIG. 1 and FIG. 5A, the backplane shroud 158 further includes side walls 512 that extend along the length of opposing sides of the backplane shroud 158. The side walls 512 include grooves 172, which run vertically along an inner surface of the side walls 512. Grooves 172 serve to guide front housing 130 of daughter card connector 120 via mating projections 132 into the appropriate position in shroud 158.

Daughter card connector 120 includes a plurality of wafers $\mathbf{122}_1 \ldots \mathbf{122}_6$ coupled together, with each of the plurality of wafers $\mathbf{122}_1 \ldots \mathbf{122}_6$ having a housing 260 (see FIGS. 2A-2C) and a column of conductive elements. In the illustrated embodiment, each column has a plurality of signal conductors 420 (see FIG. 4A) and a plurality of ground conductors 430 (see FIG. 4A). The ground conductors may be employed within each wafer $\mathbf{122}_1 \ldots \mathbf{122}_6$ to minimize crosstalk between signal conductors or to otherwise control the electrical properties of the connector.

Wafers $\mathbf{122}_1 \ldots \mathbf{122}_6$ may be formed by molding housing 260 around conductive elements that form signal and ground conductors. As with shroud 158 of backplane connector 150, housing 260 may be formed of any suitable material and may include portions that have conductive filler or are otherwise made lossy.

In the illustrated embodiment, daughter card connector 120 is a right angle connector and has conductive elements that traverse a right angle. As a result, opposing ends of the conductive elements extend from perpendicular edges of the wafers $\mathbf{122}_1 \ldots \mathbf{122}_6$.

Each conductive element of wafers $\mathbf{122}_1 \ldots \mathbf{122}_6$ has at least one contact tail, shown collectively as contact tails 126, that can be connected to daughter card 140. Each conductive element in daughter card connector 120 also has a mating contact portion, shown collectively as mating contacts 124, which can be connected to a corresponding conductive element in backplane connector 150. Each conductive element also has an intermediate portion between the mating contact portion and the contact tail, which may be enclosed by or embedded within a wafer housing 260 (see FIG. 2).

The contact tails 126 electrically connect the conductive elements within daughter card 140 and connector 120 to conductive elements, such as traces 142 in daughter card 140. In the embodiment illustrated, contact tails 126 are press fit "eye of the needle" contacts that make an electrical connection through via holes in daughter card 140. However, any suitable attachment mechanism may be used instead of or in addition to via holes and press fit contact tails.

In the illustrated embodiment, each of the mating contacts 124 has a dual beam structure configured to mate to a corresponding mating contact 154 of backplane connector 150. Though, as described below, conductive elements with wavy mating contact portions may be substituted for some or all of the conductive elements illustrated in FIG. 1 that have dual beam mating contact portions as a way to reduce spacing between mating contact portions. By reducing this spacing, there can be an increase in the number of conductive elements per unit length in each column, running in the direction C, resulting in an increase in connector density.

The conductive elements acting as signal conductors may be grouped in pairs, separated by ground conductors in a configuration suitable for use as a differential electrical connector. However, embodiments are possible for single-ended use in which the conductive elements are evenly spaced without designated ground conductors separating signal conductors or with a ground conductor between each signal conductor.

In the embodiments illustrated, some conductive elements are designated as forming a differential pair of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on preferential coupling between the conductive elements that make up the pair. Electrical characteristics of the pair, such as its impedance, that make it suitable for carrying a differential signal may provide an alternative or additional method of identifying a differential pair. As another example, in a connector with differential pairs, ground conductors may be identified by their positioning relative to the differential pairs. In other instances, ground conductors may be identified by their shape or electrical characteristics. For example, ground conductors may be relatively wide to provide low inductance, which is desirable for providing a stable reference potential, but provides an impedance that is undesirable for carrying a high speed signal.

For exemplary purposes only, daughter card connector 120 is illustrated with six wafers $\mathbf{122}_1 \ldots \mathbf{122}_6$, with each wafer having a plurality of pairs of signal conductors and adjacent ground conductors. As pictured, each of the wafers $\mathbf{122}_1 \ldots \mathbf{122}_6$ includes one column of conductive elements. However, the present invention is not limited in this regard, as the number of wafers and the number of signal conductors and ground conductors in each wafer may be varied as desired.

As shown, each wafer $\mathbf{122}_1 \ldots \mathbf{122}_6$ is inserted into front housing 130 such that mating contacts 124 are inserted into and held within openings in front housing 130. The openings in front housing 130 are positioned so as to allow mating contacts 154 of the backplane connector 150 to enter the openings in front housing 130 and allow electrical connection with mating contacts 124 when daughter card connector 120 is mated to backplane connector 150.

Daughter card connector 120 may include a support member instead of or in addition to front housing 130 to hold wafers $\mathbf{122}_1 \ldots \mathbf{122}_6$. In the pictured embodiment, stiffener 128 supports the plurality of wafers $\mathbf{122}_1 \ldots \mathbf{122}_6$. Stiffener 128 is, in the embodiment illustrated, a stamped metal member. Though, stiffener 128 may be formed from any suitable material. Stiffener 128 may be stamped with slots, holes, grooves or other features that can engage a plurality of wafers to support the wafers in the desired orientation.

Each wafer $\mathbf{122}_1 \ldots \mathbf{122}_6$ may include attachment features 242, 244 (see FIGS. 2A-2B) that engage stiffener 128 to locate each wafer 122 with respect to another and further to prevent rotation of the wafer 122. Of course, the present invention is not limited in this regard, and no stiffener need be employed. Further, although the stiffener is shown attached to an upper and side portion of the plurality of wafers, the present invention is not limited in this respect, as other suitable locations may be employed.

Figure 2B:
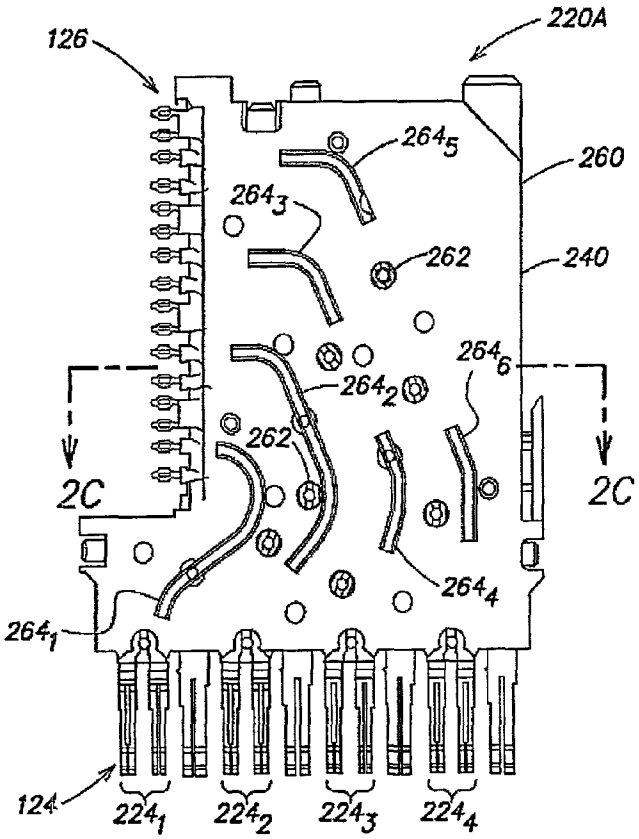
FIGS. 2A and 2B are views of a first and second side of a wafer forming a portion of the electrical connector of FIG. 1.
Figure 2A:
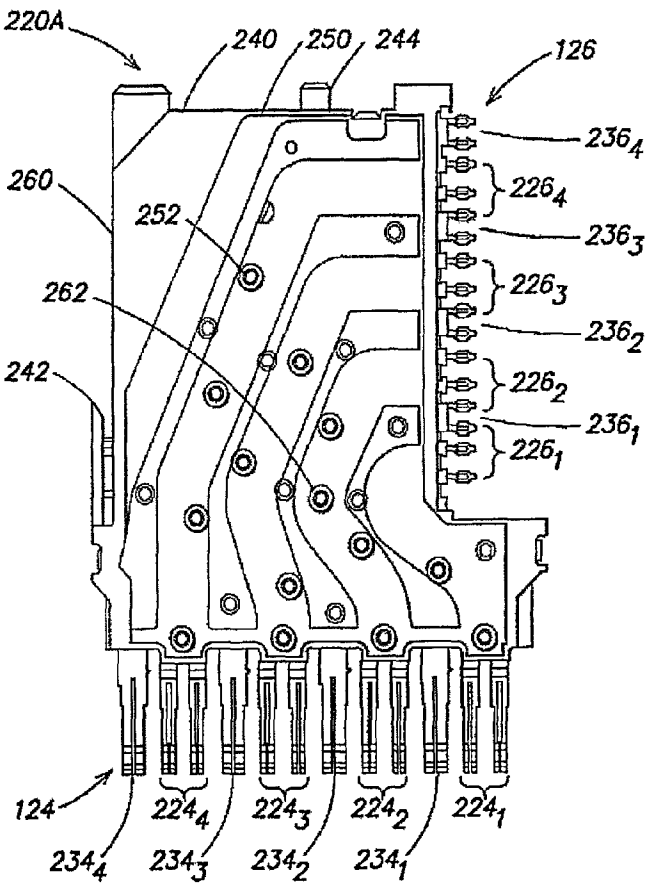

FIGS. 2A-2B illustrate opposing side views of an exemplary wafer 220A. Wafer 220A may be formed in whole or in part by injection molding of material to form housing 260 around a wafer strip assembly such as 410A or 410B (FIG. 4). In the pictured embodiment, wafer 220A is formed with a two shot molding operation, allowing housing 260 to be formed of two types of material having different material properties. Insulative portion 240 is formed in a first shot and lossy portion 250 is formed in a second shot. However, any suitable number and types of material may be used in housing 260. In one embodiment, the housing 260 is formed around a column of conductive elements by injection molding plastic.

In some embodiments, housing 260 may be provided with openings, such as windows or slots $\mathbf{264}_1 \ldots \mathbf{264}_6$, and holes, of which hole 262 is numbered, adjacent the signal conductors 420. These openings may serve multiple purposes, including to: (i) ensure during an injection molding process that the conductive elements are properly positioned, and (ii) facilitate insertion of materials that have different electrical properties, if so desired.

To obtain the desired performance characteristics, one embodiment of the present invention may employ regions of different dielectric constant selectively located adjacent signal conductors $\mathbf{310}_1$B, $\mathbf{310}_2$B . . . $\mathbf{310}_4$B of a wafer. For example, in the embodiment illustrated in FIGS. 2A-2C, the housing 260 includes slots $\mathbf{264}_1 \ldots \mathbf{264}_6$ in housing 260 that position air adjacent signal conductors $\mathbf{310}_1$B, $\mathbf{310}_2$B . . . $\mathbf{310}_4$B.

The ability to place air, or other material that has a dielectric constant lower than the dielectric constant of material used to form other portions of housing 260, in close proximity to one half of a differential pair provides a mechanism to de-skew a differential pair of signal conductors. The time it takes an electrical signal to propagate from one end of the signal conductor to the other end is known as the propagation delay. In some embodiments, it is desirable that both signal conductors within a pair have the same propagation delay, which is commonly referred to as having zero skew within the pair. The propagation delay within a conductor is influenced by the dielectric constant of material near the conductor, where a lower dielectric constant means a lower propagation delay. The dielectric constant is also sometimes referred to as the relative permittivity. A vacuum has the lowest possible dielectric constant with a value of 1. Air has a similarly low dielectric constant, whereas dielectric materials, such as LCP, have higher dielectric constants. For example, LCP has a dielectric constant of between about 2.5 and about 4.5.

Each signal conductor of the signal pair may have a different physical length, particularly in a right-angle connector. According to one aspect of the invention, to equalize the propagation delay in the signal conductors of a differential pair even though they have physically different lengths, the relative proportion of materials of different dielectric constants around the conductors may be adjusted. In some embodiments, more air is positioned in close proximity to the physically longer signal conductor of the pair than for the shorter signal conductor of the pair, thus lowering the effective dielectric constant around the signal conductor and decreasing its propagation delay.

However, as the dielectric constant is lowered, the impedance of the signal conductor rises. To maintain balanced impedance within the pair, the size of the signal conductor in closer proximity to the air may be increased in thickness or width. This results in two signal conductors with different physical geometry, but a more equal propagation delay and more inform impedance profile along the pair.

Figure 2C:
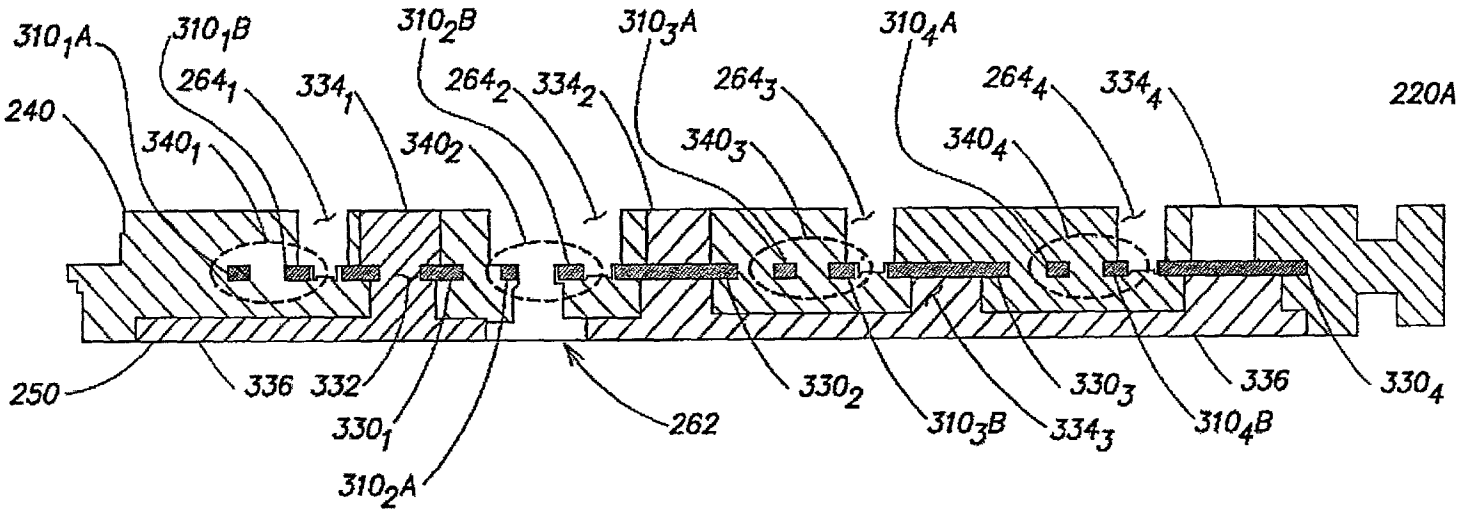
FIG. 2C is a cross-sectional representation of the wafer illustrated in FIG. 2B taken along the line 2C-2C.

FIG. 2C shows a wafer 220 in cross section taken along the line 2C-2C in FIG. 2B. As shown, a plurality of differential pairs $\mathbf{340}_1$-$\mathbf{340}_4$ are held in an array within insulative portion 240 of housing 260. In the illustrated embodiment, the array, in cross-section, is a linear array, forming a column of conductive elements.

Slots $\mathbf{264}_1 \ldots \mathbf{264}_4$ are intersected by the cross section and are therefore visible in FIG. 2C. As can be seen, slots $\mathbf{264}_1 \ldots \mathbf{264}_4$ create regions of air adjacent the longer conductor in each differential pair $\mathbf{340}_1$, $\mathbf{340}_2 \ldots \mathbf{340}_4$. Though, air is only one example of a material with a low dielectric constant that may be used for de-skewing a connector. Regions comparable to those occupied by slots $\mathbf{264}_1 \ldots \mathbf{264}_4$ as shown in FIG. 2C could be formed with a plastic with a lower dielectric constant than the plastic used to form other portions of housing 260. As another example, regions of lower dielectric constant could be formed using different types or amounts of fillers. For example, lower dielectric constant regions could be molded from plastic having less glass fiber reinforcement than in other regions.

FIG. 2C also illustrates positioning and relative dimensions of signal and ground conductors that may be used in some embodiments. As shown in FIG. 2C, intermediate portions of the signal conductors $\mathbf{310}_1$A . . . $\mathbf{310}_4$A and $\mathbf{310}_1$B . . . $\mathbf{310}_4$B are embedded within housing 260 to form a column. Intermediate portions of ground conductors $\mathbf{330}_1 \ldots \mathbf{330}_4$ may also be held within housing 260 in the same column.

Ground conductors $\mathbf{330}_1$, $\mathbf{330}_2$ and $\mathbf{330}_3$ are positioned between two adjacent differential pairs $\mathbf{340}_1$, $\mathbf{340}_2 \ldots \mathbf{340}_4$ within the column. Additional ground conductors may be included at either or both ends of the column. In wafer 220A, as illustrated in FIG. 2C, a ground conductor $\mathbf{330}_4$ is positioned at one end of the column. As shown in FIG. 2C, in some embodiments, each ground conductor $\mathbf{330}_1 \ldots \mathbf{330}_4$ is preferably wider than the signal conductors of differential pairs $\mathbf{340}_1 \ldots \mathbf{340}_4$. In the cross-section illustrated, the intermediate portion of each ground conductor has a width that is equal to or greater than three times the width of the intermediate portion of a signal conductor. In the pictured embodiment, the width of each ground conductor is sufficient to span at least the same distance along the column as a differential pair.

In the pictured embodiment, each ground conductor has a width approximately five times the width of a signal conductor such that in excess of 50% of the column width occupied by the conductive elements is occupied by the ground conductors. In the illustrated embodiment, approximately 70% of the column width occupied by conductive elements is occupied by the ground conductors $330_1 \ldots 330_4$. Increasing the percentage of each column occupied by a ground conductor can decrease cross talk within the connector. However, one approach to increasing the number of signal conductors per unit length in the column direction (illustrated by dimension C in FIG. 1) is to decrease the width of each ground conductor. Accordingly, though FIG. 2C shows the ratio of widths between ground and signal conductors to be approximately 3:1, lower ratios may be used to improve density. In some embodiments, the ratio may be 2:1 or less.

Other techniques can also be used to manufacture wafer 220A to reduce crosstalk or otherwise have desirable electrical properties. In some embodiments, one or more portions of the housing 260 are formed from a material that selectively alters the electrical and/or electromagnetic properties of that portion of the housing, thereby suppressing noise and/or crosstalk, altering the impedance of the signal conductors or otherwise imparting desirable electrical properties to the signal conductors of the wafer.

In the embodiment illustrated in FIGS. 2A-2C, housing 260 includes an insulative portion 240 and a lossy portion 250. In one embodiment, the lossy portion 250 may include a thermoplastic material filled with conducting particles. The fillers make the portion "electrically lossy." In one embodiment, the lossy regions of the housing are configured to reduce crosstalk between at least two adjacent differential pairs $340_1 \ldots 340_4$. The insulative regions of the housing may be configured so that the lossy regions do not attenuate signals carried by the differential pairs $340_1 \ldots 340_4$ an undesirable amount.

Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in the lossy portion 250 of the housing may be disposed generally evenly throughout, rendering a conductivity of the lossy portion generally constant. In other embodiments, a first region of the lossy portion 250 may be more conductive than a second region of the lossy portion 250 so that the conductivity, and therefore amount of loss within the lossy portion 250 may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer 220A to form all or part of the housing and may be positioned to adhere to ground conductors in the wafer. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In the embodiment illustrated in FIG. 2C, the wafer housing 260 is molded with two types of material. In the pictured embodiment, lossy portion 250 is formed of a material having a conductive filler, whereas the insulative portion 240 is formed from an insulative material having little or no conductive fillers, though insulative portions may have fillers, such as glass fiber, that alter mechanical properties of the binder material or impacts other electrical properties, such as dielectric constant, of the binder. In one embodiment, the insulative portion 240 is formed of molded plastic and the lossy portion is formed of molded plastic with conductive fillers. In some embodiments, the lossy portion 250 is sufficiently lossy that it attenuates radiation between differential pairs to a sufficient amount that crosstalk is reduced to a level that a separate metal plate is not required.

To prevent signal conductors $\mathbf{310}_1$A, $\mathbf{310}_1$B . . . $\mathbf{310}_4$A, and $\mathbf{310}_4$B from being shorted together and/or from being shorted to ground by lossy portion 250, insulative portion 240, formed of a suitable dielectric material, may be used to insulate the signal conductors. The insulative materials may be, for example, a thermoplastic binder into which non-conducting fibers are introduced for added strength, dimensional stability and to reduce the amount of higher priced binder used. Glass fibers, as in a conventional electrical connector, may have a loading of about 30% by volume. It should be appreciated that in other embodiments, other materials may be used, as the invention is not so limited.

In the embodiment of FIG. 2C, the lossy portion 250 includes a parallel region 336 and perpendicular regions $\mathbf{334}_1$ . . . $\mathbf{334}_4$. In one embodiment, perpendicular regions $\mathbf{334}_1$ . . . $\mathbf{334}_4$ are disposed between adjacent conductive elements that form separate differential pairs $\mathbf{340}_1$ . . . $\mathbf{340}_4$.

In some embodiments, the lossy regions 336 and $\mathbf{334}_1$ . . . $\mathbf{334}_4$ of the housing 260 and the ground conductors $\mathbf{330}_1$ . . . $\mathbf{330}_4$ cooperate to shield the differential pairs $\mathbf{340}_1$ . . . $\mathbf{340}_4$ to reduce crosstalk. The lossy regions 336 and $\mathbf{334}_1$ . . . $\mathbf{334}_4$ may be grounded by being electrically coupled to one or more ground conductors. Such coupling may be the result of direct contact between the electrically lossy material and a ground conductor or may be indirect, such as through capacitive coupling. This configuration of lossy material in combination with ground conductors $\mathbf{330}_1$ . . . $\mathbf{330}_4$ reduces crosstalk between differential pairs within a column.

As shown in FIG. 2C, portions of the ground conductors $\mathbf{330}_1$ . . . $\mathbf{330}_4$, may be electrically connected to regions 336 and $\mathbf{334}_1$ . . . $\mathbf{334}_4$ by molding portion 250 around ground conductors $\mathbf{340}_1$ . . . $\mathbf{340}_4$. In some embodiments, ground conductors may include openings through which the material forming the housing can flow during molding. For example, the cross section illustrated in FIG. 2C is taken through an opening 332 in ground conductor $\mathbf{330}_1$. Though not visible in the cross section of FIG. 2C, other openings in other ground conductors such as $\mathbf{330}_2$ . . . $\mathbf{330}_4$ may be included.

Material that flows through openings in the ground conductors allows perpendicular portions $\mathbf{334}_1$ . . . $\mathbf{334}_4$ to extend through ground conductors even though a mold cavity used to form a wafer 220A has inlets on only one side of the ground conductors. Additionally, flowing material through openings in ground conductors as part of a molding operation may aid in securing the ground conductors in housing 260 and may enhance the electrical connection between the lossy portion 250 and the ground conductors. However, other suitable methods of forming perpendicular portions $\mathbf{334}_1$ . . . $\mathbf{334}_4$ may also be used, including molding wafer 320A in a cavity that has inlets on two sides of ground conductors $\mathbf{330}_1$ . . . $\mathbf{330}_4$. Likewise, other suitable methods for securing the ground contacts 330 may be employed, as the present invention is not limited in this respect.

Forming the lossy portion 250 of the housing from a moldable material can provide additional benefits. For example, the lossy material at one or more locations can be configured to set the performance of the connector at that location. For example, changing the thickness of a lossy portion to space signal conductors closer to or further away from the lossy portion 250 can alter the performance of the connector. As such, electromagnetic coupling between one differential pair and ground and another differential pair and ground can be altered, thereby configuring the amount of loss for radiation between adjacent differential pairs and the amount of loss to signals carried by those differential pairs. As a result, a connector according to embodiments of the invention may be capable of use at higher frequencies than conventional connectors, such as for example at frequencies between 10-15 GHz.

As shown in the embodiment of FIG. 2C, wafer 220A is designed to carry differential signals. Thus, each signal is carried by a pair of signal conductors $\mathbf{310}_1$A and $\mathbf{310}_1$B, . . . $\mathbf{310}_4$A, and $\mathbf{310}_4$B. Preferably, each signal conductor is closer to the other conductor in its pair than it is to a conductor in an adjacent pair. For example, a pair $\mathbf{340}_1$ carries one differential signal, and pair $\mathbf{340}_2$ carries another differential signal. As can be seen in the cross section of FIG. 2C, signal conductor $\mathbf{310}_1$B is closer to signal conductor $\mathbf{310}_1$A than to signal conductor $\mathbf{310}_2$A. Perpendicular lossy regions $\mathbf{334}_1$ . . . $\mathbf{334}_4$ may be positioned between pairs to provide shielding between the adjacent differential pairs in the same column.

Figure 3:
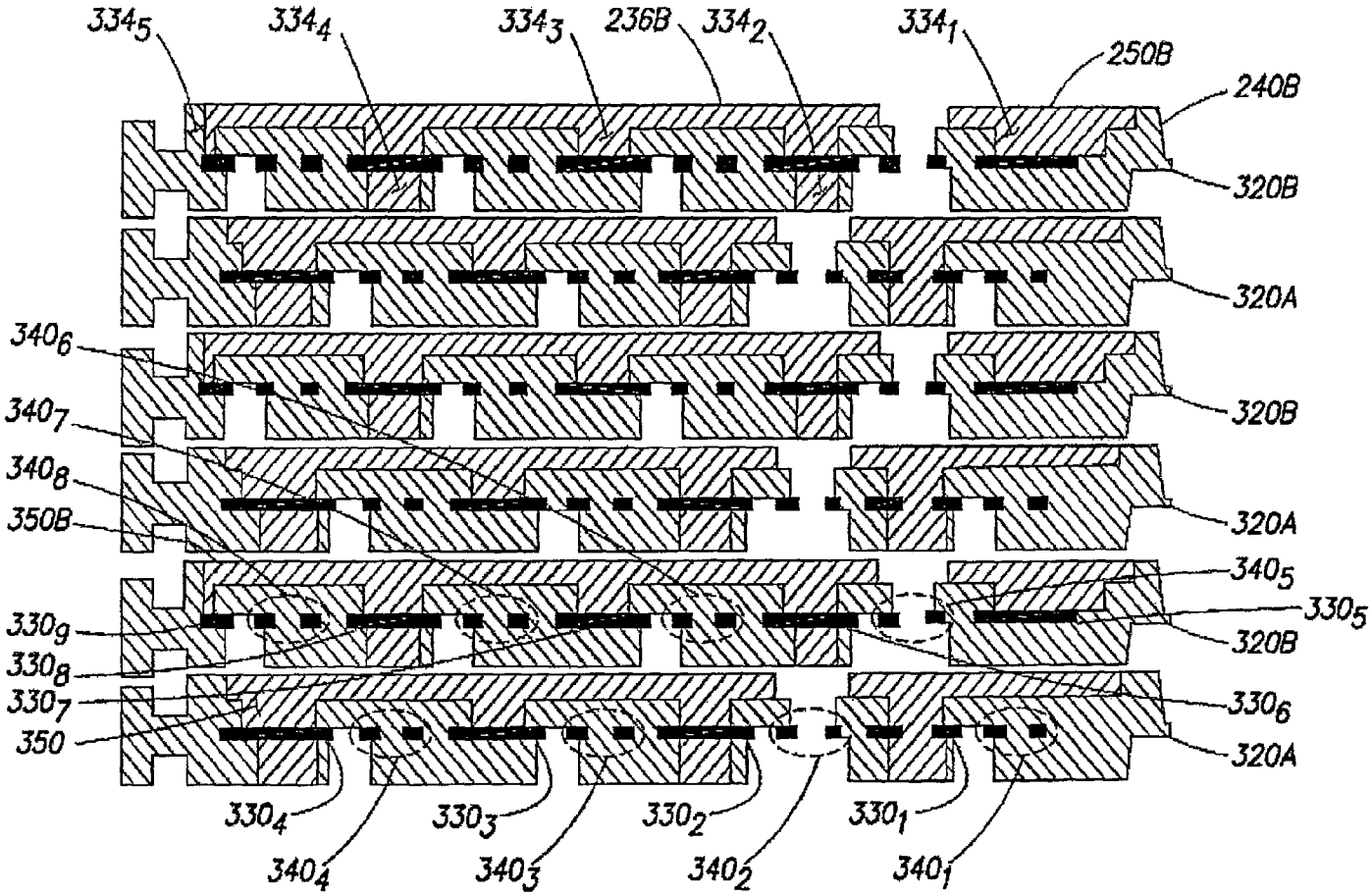
FIG. 3 is a cross-sectional representation of a plurality of wafers stacked together in a connector as in FIG. 1.

Lossy material may also be positioned to reduce the crosstalk between adjacent pairs in different columns. FIG. 3 illustrates a cross-sectional view similar to FIG. 2C but with a plurality of subassemblies or wafers 320A, 320B aligned side to side to form multiple parallel columns.

As illustrated in FIG. 3, the plurality of signal conductors 340 may be arranged in differential pairs in a plurality of columns formed by positioning wafers side by side. It is not necessary that each wafer be the same and different types of wafers may be used.

It may be desirable for all types of wafers used to construct a daughter card connector to have an outer envelope of approximately the same dimensions so that all wafers fit within the same enclosure or can be attached to the same support member, such as stiffener 128 (FIG. 1). However, by providing different placement of the signal conductors, ground conductors and lossy portions in different wafers, the amount that the lossy material reduces crosstalk relative to the amount that it attenuates signals may be more readily configured. In one embodiment, two types of wafers are used, which are illustrated in FIG. 3 as subassemblies or wafers 320A and 320B.

Each of the wafers 320B may include structures similar to those in wafer 320A as illustrated in FIGS. 2A, 2B and 2C. As shown in FIG. 3, wafers 320B include multiple differential pairs, such as pairs $\mathbf{340}_5$, $\mathbf{340}_6$, $\mathbf{340}_7$ and $\mathbf{340}_8$. The signal pairs may be held within an insulative portion, such as 240B of a housing. Slots or other structures, not numbered) may be formed within the housing for skew equalization in the same way that slots $\mathbf{264}_1$-$\mathbf{264}_6$ are formed in a wafer 220A.

The housing for a wafer 320B may also include lossy portions, such as lossy portions 250B. As with lossy portions 250 described in connection with wafer 320A in FIG. 2C, lossy portions 250B may be positioned to reduce crosstalk between adjacent differential pairs. The lossy portions 250B may be shaped to provide a desirable level of crosstalk suppression without causing an undesired amount of signal attenuation.

In the embodiment illustrated, lossy portion 250B may have a substantially parallel region 336B that is parallel to the columns of differential pairs $\mathbf{340}_5 \ldots \mathbf{340}_8$. Each lossy portion 250B may further include a plurality of perpendicular regions $\mathbf{334}_1$B . . . $\mathbf{334}_5$B, which extend from the parallel region 336B. The perpendicular regions $\mathbf{334}_1$B . . . $\mathbf{334}_5$B may be spaced apart and disposed between adjacent differential pairs within a column.

Wafers 320B also include ground conductors, such as ground conductors $\mathbf{330}_5 \ldots \mathbf{330}_9$. As with wafers 320A, the ground conductors are positioned adjacent differential pairs $\mathbf{340}_5 \ldots \mathbf{340}_8$. Also, as in wafers 320A, the ground conductors generally have a width greater than the width of the signal conductors. In the embodiment pictured in FIG. 3, ground conductors $\mathbf{330}_5 \ldots \mathbf{330}_8$ have generally the same shape as ground conductors $\mathbf{330}_1 \ldots \mathbf{330}_4$ in a wafer 320A. However, in the embodiment illustrated, ground conductor $\mathbf{330}_9$ has a width that is less than the ground conductors $\mathbf{330}_5 \ldots \mathbf{330}_8$ in wafer 320B.

Ground conductor $\mathbf{330}_9$ is narrower to provide desired electrical properties without requiring the wafer 320B to be undesirably wide. Ground conductor $\mathbf{330}_9$ has an edge facing differential pair $\mathbf{340}_8$. Accordingly, differential pair $\mathbf{340}_8$ is positioned relative to a ground conductor similarly to adjacent differential pairs, such as differential pair $\mathbf{330}_8$ in wafer 320B or pair $\mathbf{340}_4$ in a wafer 320A. As a result, the electrical properties of differential pair $\mathbf{340}_8$ are similar to those of other differential pairs. By making ground conductor $\mathbf{330}_9$ narrower than ground conductors $\mathbf{330}_8$ or $\mathbf{330}_4$, wafer 320B may be made with a smaller size.

A similar small ground conductor could be included in wafer 320A adjacent pair $\mathbf{340}_1$. However, in the embodiment illustrated, pair $\mathbf{340}_1$ is the shortest of all differential pairs within daughter card connector 120. Though including a narrow ground conductor in wafer 320A could make the ground configuration of differential pair $\mathbf{340}_1$ more similar to the configuration of adjacent differential pairs in wafers 320A and 320B, the net effect of differences in ground configuration may be proportional to the length of the conductor over which those differences exist. Because differential pair $\mathbf{340}_1$ is relatively short, in the embodiment of FIG. 3, a second ground conductor adjacent to differential pair $\mathbf{340}_1$, though it would change the electrical characteristics of that pair, may have relatively little net effect. However, in other embodiments, a further ground conductor may be included in wafers 320A. FIG. 3 illustrates in narrow ground conductor $\mathbf{330}_9$, a possible approach for providing a grounding structure adjacent pair 350B. An alternative approach is described below in conjunction with FIGS. 8A, 8B, 9A, 9B, 10A, 10B and 10C that can provide the same number of signal conductors in a connector that takes up less space in the column direction. As in the embodiment of FIG. 3, grounding is provided adjacent pair $\mathbf{330}_9$ as the longest pair in the connector but similar grounding at the end of the column is not provided for pair $\mathbf{340}_1$ in wafers 320A. However, as with narrow ground contacts $\mathbf{330}_9$, the alternative grounding structure of FIGS. 8A, 8B, 9A, 9B, 10A, 10B and 10C may alternatively or additionally be applied adjacent pairs $\mathbf{340}_1$.

FIG. 3 illustrates a further feature possible when using multiple types of wafers to form a daughter card connector. Because the columns of contacts in wafers 320A and 320B have different configurations, when wafer 320A is placed side by side with wafer 320B, the differential pairs in wafer 320A are more closely aligned with ground conductors in wafer 320B than with adjacent pairs of signal conductors in wafer 320B. Conversely, the differential pairs of wafer 320B are more closely aligned with ground conductors than adjacent differential pairs in the wafer 320A.

For example, differential pair $\mathbf{340}_6$ is proximate ground conductor $\mathbf{330}_2$ in wafer 320A. Similarly, differential pair $\mathbf{340}_3$ in wafer 320A is proximate ground conductor $\mathbf{330}_7$ in wafer 320B. In this way, radiation from a differential pair in one column couples more strongly to a ground conductor in an adjacent column than to a signal conductor in that column. This configuration reduces crosstalk between differential pairs in adjacent columns.

Wafers with different configurations may be formed in any suitable way. FIG. 4A illustrates a step in the manufacture of wafers 320A and 320B according to one embodiment. In the illustrated embodiment, wafer strip assemblies, each containing conductive elements in a configuration desired for one column of a daughter card connector, are formed. A housing is then molded around the conductive elements in each wafer strip assembly in an insert molding operation to form a wafer.

To facilitate the manufacture of wafers, signal conductors, of which signal conductor 420 is numbered and ground conductors, of which ground conductor 430 is numbered, may be held together on a lead frame 400 as shown in FIG. 4A. As shown, the signal conductors 420 and the ground conductors 430 are attached to one or more carrier strips 402. In some embodiments, the signal conductors and ground conductors are stamped for many wafers on a single sheet. The sheet may be metal or may be any other material that is conductive and provides suitable mechanical properties for making a conductive element in an electrical connector. Phosphor-bronze, beryllium copper and other copper alloys are example of materials that may be used.

Embodiments in which conductive elements have configurations other than those shown in FIG. 4A are described below. However, similar materials and manufacturing techniques may be used to form those conductive elements.

FIG. 4A illustrates a portion of a sheet of metal in which wafer strip assemblies 410A, 410B have been stamped. Wafer strip assemblies 410A, 410B may be used to form wafers 320A and 320B, respectively. Conductive elements may be retained in a desired position on carrier strips 402. The conductive elements may then be more readily handled during manufacture of wafers. Once material is molded around the conductive elements, the carrier strips may be severed to separate the conductive elements. The wafers may then be assembled into daughter board connectors of any suitable size.

FIG. 4A also provides a more detailed view of features of the conductive elements of the daughter card wafers. The width of a ground conductor, such as ground conductor 430, relative to a signal conductor, such as signal conductor 420, is apparent. Also, openings in ground conductors, such as opening 332, are visible.

The wafer strip assemblies shown in FIG. 4A provide just one example of a component that may be used in the manufacture of wafers. For example, in the embodiment illustrated in FIG. 4A, the lead frame 400 includes tie bars 452, 454 and 456 that connect various portions of the signal conductors 420 and/or ground strips 430 to the lead frame 400. These tie bars may be severed during subsequent manufacturing processes to provide electronically separate conductive elements. A sheet of metal may be stamped such that one or more additional carrier strips are formed at other locations and/or bridging members between conductive elements may be employed for positioning and support of the conductive elements during manufacture. Accordingly, the details shown in FIG. 4A are illustrative and not a limitation on the invention.

Although the lead frame 400 is shown as including both ground conductors 430 and the signal conductors 420, the present invention is not limited in this respect. For example, the respective conductors may be formed in two separate lead frames. Indeed, no lead frame need be used and individual conductive elements may be employed during manufacture. It should be appreciated that molding over one or both lead frames or the individual conductive elements need not be performed at all, as the wafer may be assembled by inserting ground conductors and signal conductors into preformed housing portions, which may then be secured together with various features including snap fit features.

Figure 4B:
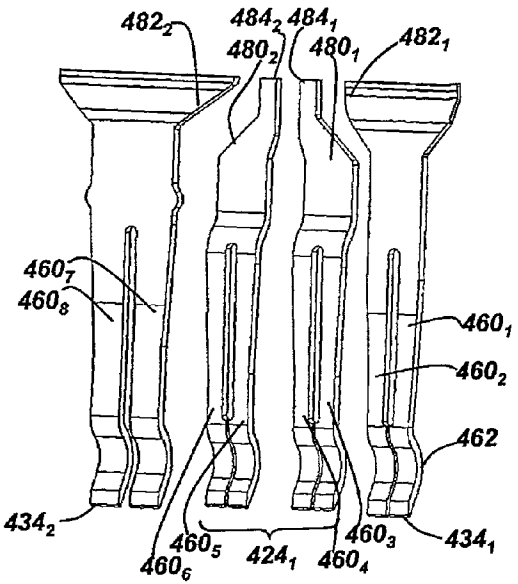
FIG. 4B is an enlarged detail view of the area encircled by arrow 4B-4B in FIG. 4A.
Figure 4A:
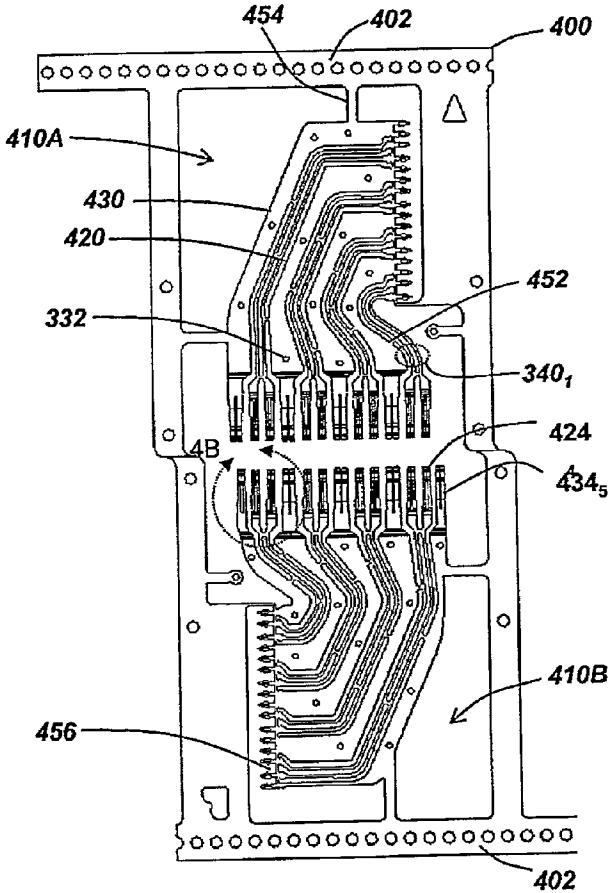
FIG. 4A is a plan view of a lead frame used in the manufacture of the connector of FIG. 1.

FIG. 4B illustrates a detailed view of the mating contact end of a differential pair $\mathbf{424}_1$ positioned between two ground mating contacts $\mathbf{434}_1$ and $\mathbf{434}_2$. As illustrated, the ground conductors may include mating contacts of different sizes. The embodiment pictured has a large mating contact $\mathbf{434}_2$ and a small mating contact $\mathbf{434}_1$. To reduce the size of each wafer, small mating contacts $\mathbf{434}_1$ may be positioned on one or both ends of the wafer. Though, in embodiments in which it is desirable to increase the overall density of the connector, all of the ground conductors may have dimensions comparable to small mating contact $\mathbf{434}_1$, which is slightly wider than the signal conductors of differential pair $\mathbf{424}_1$. In yet other embodiments, the mating contact portions of both signal and ground conductors may be of approximately the same width.

FIG. 4B illustrates features of the mating contact portions of the conductive elements within the wafers forming daughter board connector 120. FIG. 4B illustrates a portion of the mating contacts of a wafer configured as wafer 320B. The portion shown illustrates a mating contact $\mathbf{434}_1$ such as may be used at the end of a ground conductor $\mathbf{330}_9$ (FIG. 3). Mating contacts $\mathbf{424}_1$ may form the mating contact portions of signal conductors, such as those in differential pair $\mathbf{340}_8$ (FIG. 3). Likewise, mating contact $\mathbf{434}_2$ may form the mating contact portion of a ground conductor, such as ground conductor $\mathbf{330}_8$ (FIG. 3).

In the embodiment illustrated in FIG. 4B, each of the mating contacts on a conductive element in a daughter card wafer is a dual beam contact. Mating contact $\mathbf{434}_1$ includes beams $\mathbf{460}_1$ and $\mathbf{460}_2$. Mating contacts $\mathbf{424}_1$ includes four beams, two for each of the signal conductors of the differential pair terminated by mating contact $\mathbf{424}_1$. In the illustration of FIG. 4B, beams $\mathbf{460}_3$ and $\mathbf{460}_4$ provide two beams for a contact for one signal conductor of the pair and beams $\mathbf{460}_5$ and $\mathbf{460}_6$ provide two beams for a contact for a second signal conductor of the pair. Likewise, mating contact $\mathbf{434}_2$ includes two beams $\mathbf{460}_7$ and $\mathbf{460}_8$.

Each of the beams includes a mating surface, of which mating surface 462 on beam $\mathbf{460}_1$ is numbered. To form a reliable electrical connection between a conductive element in the daughter card connector 120 and a corresponding conductive element in backplane connector 150, each of the beams $\mathbf{460}_1 \ldots \mathbf{460}_8$ may be shaped to press against a corresponding mating contact in the backplane connector 150 with sufficient mechanical force to create a reliable electrical connection. Having two beams per contact increases the likelihood that an electrical connection will be formed even if one beam is damaged, contaminated or otherwise precluded from making an effective connection.

Each of beams $\mathbf{460}_1 \ldots \mathbf{460}_8$ has a shape that generates mechanical force for making an electrical connection to a corresponding contact. In the embodiment of FIG. 4B, the signal conductors terminating at mating contact $\mathbf{424}_1$ may have relatively narrow intermediate portions $\mathbf{484}_1$ and $\mathbf{484}_2$ within the housing of wafer 320D. However, to form an effective electrical connection, the mating contact portions $\mathbf{424}_1$ for the signal conductors may be wider than the intermediate portions $\mathbf{484}_1$ and $\mathbf{484}_2$. Accordingly, FIG. 4B shows broadening portions $\mathbf{480}_1$ and $\mathbf{480}_2$ associated with each of the signal conductors.

In the illustrated embodiment, the ground conductors adjacent broadening portions $\mathbf{480}_1$ and $\mathbf{480}_2$ are shaped to conform to the adjacent edge of the signal conductors. Accordingly, mating contact $\mathbf{434}_1$ for a ground conductor has a complementary portion $\mathbf{482}_1$ with a shape that conforms to broadening portion $\mathbf{480}_1$. Likewise, mating contact $\mathbf{434}_2$ has a complementary portion $\mathbf{482}_2$ that conforms to broadening portion $\mathbf{480}_2$. By incorporating complementary portions in the ground conductors, the edge-to-edge spacing between the signal conductors and adjacent ground conductors remains relatively constant, even as the width of the signal conductors change at the mating contact region to provide desired mechanical properties to the beams. Maintaining a uniform spacing may further contribute to desirable electrical properties for an interconnection system according to an embodiment of the invention.

Some or all of the construction techniques employed within daughter card connector 120 for providing desirable characteristics may be employed in backplane connector 150. In the illustrated embodiment, backplane connector 150, like daughter card connector 120, includes features for providing desirable signal transmission properties. Signal conductors in backplane connector 150 are arranged in columns, each containing differential pairs interspersed with ground conductors. The ground conductors are wide relative to the signal conductors. Also, adjacent columns have different configurations. Some of the columns may have narrow ground conductors at the end to save space while providing a desired ground configuration around signal conductors at the ends of the columns. Additionally, ground conductors in one column may be positioned adjacent to differential pairs in an adjacent column as a way to reduce crosstalk from one column to the next. Further, lossy material may be selectively placed within the shroud of backplane connector 150 to reduce crosstalk, without providing an undesirable level of attenuation to signals. Further, adjacent signals and grounds may have conforming portions so that in locations where the profile of either a signal conductor or a ground conductor changes, the signal-to-ground spacing may be maintained.

Figure 5B:
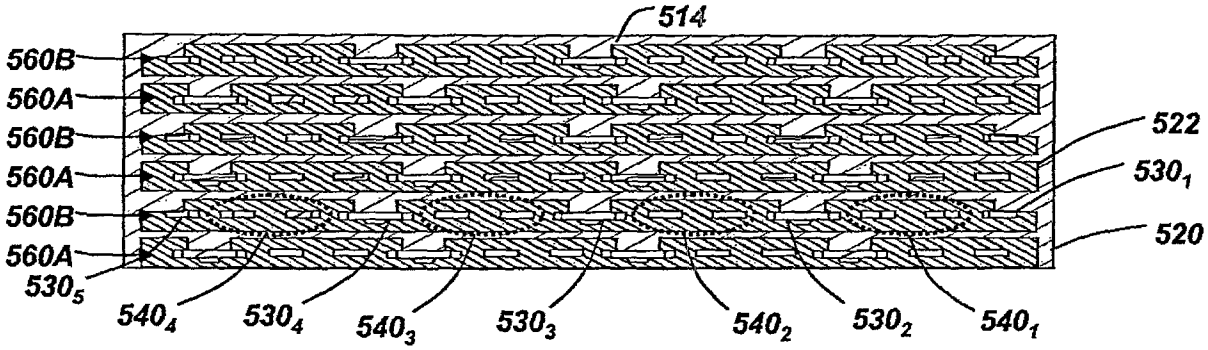
FIG. 5B is a cross-sectional representation of the backplane connector illustrated in FIG. 5A taken along the line 5B-5B.

FIGS. 5A-5B illustrate an embodiment of a backplane connector 150 in greater detail. In the illustrated embodiment, backplane connector 150 includes a shroud 510 with walls 512 and floor 514. Conductive elements are inserted into shroud 510. In the embodiment shown, each conductive element has a portion extending above floor 514. These portions form the mating contact portions of the conductive elements, collectively numbered 154. Each conductive element has a portion extending below floor 514. These portions form the contact tails and are collectively numbered 156.

The conductive elements of backplane connector 150 are positioned to align with the conductive elements in daughter card connector 120. Accordingly, FIG. 5A shows conductive elements in backplane connector 150 arranged in multiple parallel columns. In the embodiment illustrated, each of the parallel columns includes multiple differential pairs of signal conductors, of which differential pairs $\mathbf{540}_1, \mathbf{540}_2 \ldots \mathbf{540}_4$ are numbered. Each column also includes multiple ground conductors. In the embodiment illustrated in FIG. 5A, ground conductors $\mathbf{530}_1, \mathbf{530}_2 \ldots \mathbf{530}_5$ are numbered.

Ground conductors $\mathbf{530}_1 \ldots \mathbf{530}_5$ and differential pairs $\mathbf{540}_1 \ldots \mathbf{540}_4$ are positioned to form one column of conductive elements within backplane connector 150. That column has conductive elements positioned to align with a column of conductive elements as in a wafer 320B (FIG. 3). An adjacent column of conductive elements within backplane connector 150 may have conductive elements positioned to align with mating contact portions of a wafer 320A. The columns in backplane connector 150 may alternate configurations from column to column to match the alternating pattern of wafers 320A, 320B shown in FIG. 3.

Ground conductors $\mathbf{530}_2$, $\mathbf{530}_3$ and $\mathbf{530}_4$ are shown to be wide relative to the signal conductors that make up the differential pairs by $\mathbf{540}_1 \ldots \mathbf{540}_4$. Narrower ground conductive elements, which are narrower relative to ground conductors $\mathbf{530}_2$, $\mathbf{530}_3$ and $\mathbf{530}_4$, are included at each end of the column. In the embodiment illustrated in FIG. 5A, narrower ground conductors $\mathbf{530}_1$ and $\mathbf{530}_5$ are including at the ends of the column containing differential pairs $\mathbf{540}_1 \ldots \mathbf{540}_4$ and may, for example, mate with a ground conductor from daughter card 120 with a mating contact portion shaped as mating contact $\mathbf{434}_1$ (FIG. 4B).

FIG. 5B shows a view of backplane connector 150 taken along the line labeled B-B in FIG. 5A. In the illustration of FIG. 5B, an alternating pattern of columns of 560A-560B is visible. A column containing differential pairs $\mathbf{540}_1 \ldots \mathbf{540}_4$ is shown as column 560B.

FIG. 5B shows that shroud 510 may contain both insulative and lossy regions. In the illustrated embodiment, each of the conductive elements of a differential pair, such as differential pairs $\mathbf{540}_1 \ldots \mathbf{540}_4$, is held within an insulative region 522. Lossy regions 520 may be positioned between adjacent differential pairs within the same column and between adjacent differential pairs in adjacent columns. Lossy regions 520 may connect to the ground contacts such as $\mathbf{530}_1 \ldots \mathbf{530}_5$. Sidewalls 512 may be made of either insulative or lossy material.

FIGS. 6A, 6B and 6C illustrate in greater detail conductive elements that may be used in forming backplane connector 150. FIG. 6A shows multiple wide ground contacts $\mathbf{530}_2$, $\mathbf{530}_3$ and $\mathbf{530}_4$. In the configuration shown in FIG. 6A, the ground contacts are attached to a carrier strip 620. The ground contacts may be stamped from a long sheet of metal or other conductive material, including a carrier strip 620. The individual contacts may be severed from carrier strip 620 at any suitable time during the manufacturing operation.

As can be seen, each of the ground contacts has a mating contact portion shaped as a blade. For additional stiffness, one or more stiffening structures may be formed in each contact. In the embodiment of FIG. 6A, a rib, such as 610 is formed in each of the wide ground conductors.

Each of the wide ground conductors, such as $\mathbf{530}_2 \ldots \mathbf{530}_4$ includes two contact tails. For ground conductor $\mathbf{530}_2$ contact tails $\mathbf{656}_1$ and $\mathbf{656}_2$ are numbered. Providing two contact tails per wide ground conductor provides for a more even distribution of grounding structures throughout the entire interconnection system, including within backplane 160, because each of contact tails $\mathbf{656}_1$ and $\mathbf{656}_2$ will engage a ground via within backplane 160 that will be parallel and adjacent a via carrying a signal. FIG. 4A illustrates that two ground contact tails may also be used for each ground conductor in a daughter card connector.

FIG. 6B shows a stamping containing narrower ground conductors, such as ground conductors $\mathbf{530}_1$ and $\mathbf{530}_5$. As with the wider ground conductors shown in FIG. 6A, the narrower ground conductors of FIG. 6B have a mating contact portion shaped like a blade.

As with the stamping of FIG. 6A, the stamping of FIG. 6B containing narrower grounds includes a carrier strip 630 to facilitate handling of the conductive elements. The individual ground conductors may be severed from carrier strip 630 at any suitable time, either before or after insertion into backplane connector shroud 510.

In the embodiment illustrated, each of the narrower ground conductors, such as $\mathbf{530}_1$ and $\mathbf{530}_2$, contains a single contact tail such as $\mathbf{656}_3$ on ground conductor $\mathbf{530}_1$ or contact tail $\mathbf{656}_4$ on ground conductor $\mathbf{530}_5$. Even though only one ground contact tail is included, the relationship between number of signal contacts is maintained because narrow ground conductors as shown in FIG. 6B are used at the ends of columns where they are adjacent a single signal conductor. As can be seen from the illustration in FIG. 6B, each of the contact tails for a narrower ground conductor is offset from the center line of the mating contact in the same way that contact tails $\mathbf{656}_1$ and $\mathbf{656}_2$ are displaced from the center line of wide contacts. This configuration may be used to preserve the spacing between a ground contact tail and an adjacent signal contact tail.

As can be seen in FIG. 5A, in the pictured embodiment of backplane connector 150, the narrower ground conductors, such as $\mathbf{530}_1$ and $\mathbf{530}_5$, are also shorter than the wider ground conductors such as $\mathbf{530}_2 \ldots \mathbf{530}_4$. The narrower ground conductors shown in FIG. 6B do not include a stiffening structure, such as ribs 610 (FIG. 6A). However, embodiments of narrower ground conductors may be formed with stiffening structures.

FIG. 6C shows signal conductors that may be used to form backplane connector 150. The signal conductors in FIG. 6C, like the ground conductors of FIGS. 6A and 6B, may be stamped from a sheet of metal. In the embodiment of FIG. 6C, the signal conductors are stamped in pairs, such as pairs $\mathbf{540}_1$ and $\mathbf{540}_2$. The stamping of FIG. 6C includes a carrier strip 640 to facilitate handling of the conductive elements. The pairs, such as $\mathbf{540}_1$ and $\mathbf{540}_2$, may be severed from carrier strip 640 at any suitable point during manufacture.

As can be seen from FIGS. 5A, 6A, 6B and 6C, the signal conductors and ground conductors for backplane connector 150 may be shaped to conform to each other to maintain a consistent spacing between the signal conductors and ground conductors. For example, ground conductors have projections, such as projection 660, that position the ground conductor relative to floor 514 of shroud 510. The signal conductors have complimentary portions, such as complimentary portion 662 (FIG. 6C) so that when a signal conductor is inserted into shroud 510 next to a ground conductor, the spacing between the edges of the signal conductor and the ground conductor stays relatively uniform, even in the vicinity of projections 660.

Likewise, signal conductors have projections, such as projections 664 (FIG. 6C). Projection 664 may act as a retention feature that holds the signal conductor within the floor 514 of backplane connector shroud 510 (FIG. 5A). Ground conductors may have complimentary portions, such as complementary portion 666 (FIG. 6A). When a signal conductor is placed adjacent a ground conductor, complimentary portion 666 maintains a relatively uniform spacing between the edges of the signal conductor and the ground conductor, even in the vicinity of projection 664.

FIGS. 6A, 6B and 6C illustrate examples of projections in the edges of signal and ground conductors and corresponding complimentary portions formed in an adjacent signal or ground conductor. Other types of projections may be formed and other shapes of complementary portions may likewise be formed.

To facilitate use of signal and ground conductors with complementary portions, backplane connector 150 may be manufactured by inserting signal conductors and ground conductors into shroud 510 from opposite sides. As can be seen in FIG. 5A, projections such as 660 (FIG. 6A) of ground conductors press against the bottom surface of floor 514. Backplane connector 150 may be assembled by inserting the ground conductors into shroud 510 from the bottom until projections 660 engage the underside of floor 514. Because signal conductors in backplane connector 150 are generally complementary to the ground conductors, the signal conductors have narrow portions adjacent the lower surface of floor 514. The wider portions of the signal conductors are adjacent the top surface of floor 514. Because manufacture of a backplane connector may be simplified if the conductive elements are inserted into shroud 510 narrow end first, backplane connector 150 may be assembled by inserting signal conductors into shroud 510 from the upper surface of floor 514. The signal conductors may be inserted until projections, such as projection 664, engage the upper surface of the floor. Two-sided insertion of conductive elements into shroud 510 facilitates manufacture of connector portions with conforming signal and ground conductors.

Figure 7C:
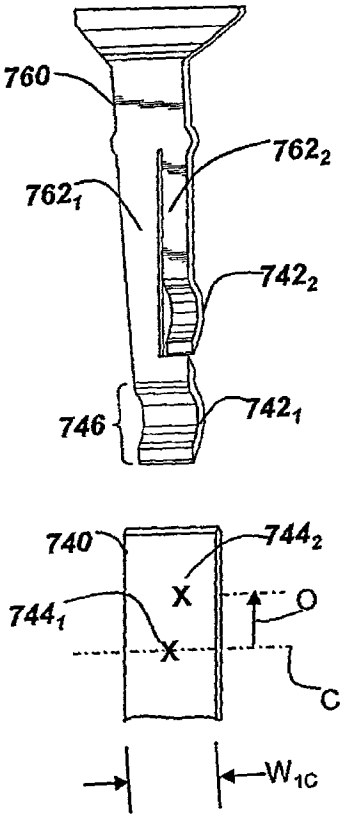
FIG. 7C is a sketch of a further alternative configuration of a mating contact portion of a conductive element in a connector.
Figure 7B:
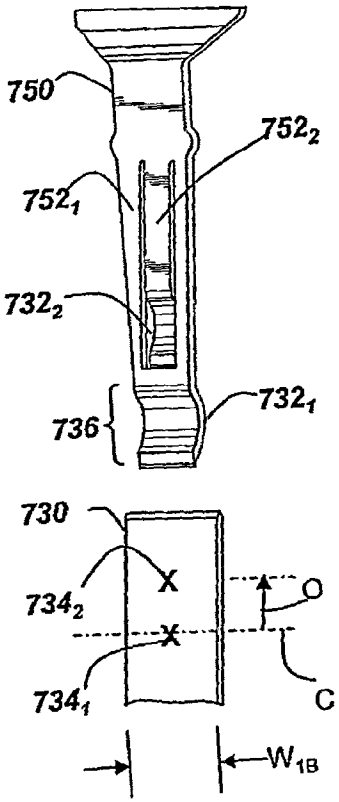
FIG. 7B is a sketch of an alternative configuration of a mating contact portion of a conductive element in a connector.
Figure 7A:
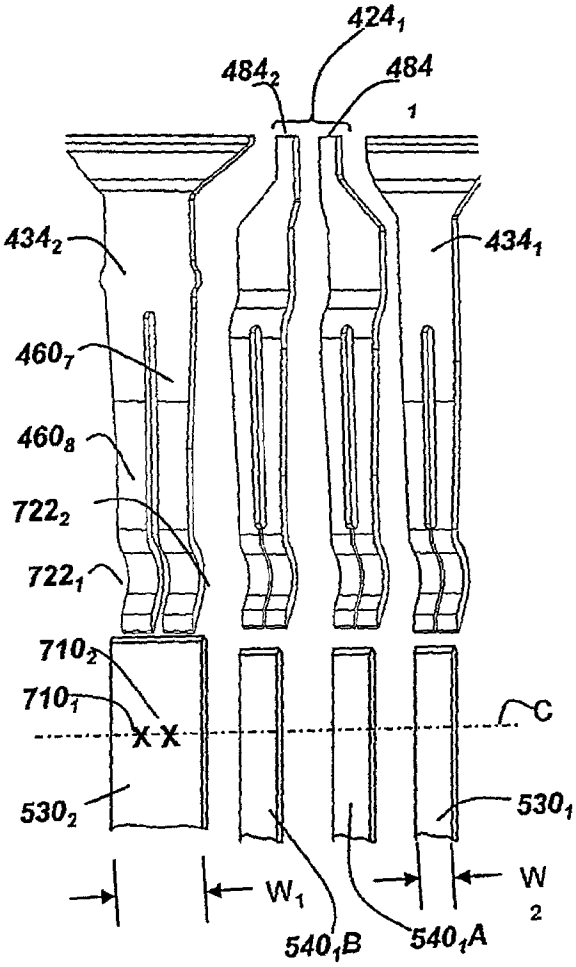
FIG. 7A is a sketch of the mating portions of lead frames in two mating connectors.

FIG. 7A is a sketch of a portion of a lead frame such as may be used in a daughter card connector according to an embodiment of the invention. FIG. 7A shows mating contacts $\mathbf{424}_1$, which may be the mating contact portions of a pair of signal conductors in a daughter card wafer. As shown, mating contacts $\mathbf{424}_1$ are aligned to fall in a column C of mating contact portions in a daughter card connector.

Also aligned with mating contacts $\mathbf{424}_1$ in column C of mating are contacts $\mathbf{434}_1$ and $\mathbf{434}_2$, which may form the mating contact portions of ground conductors within the daughter card connector. The illustrated configuration positions a ground conductor in the column on both sides of mating contacts $\mathbf{424}_1$. Mating contact $\mathbf{434}_1$ is, in the embodiment illustrated, narrower than mating contact $\mathbf{434}_2$.

As described above, it is desirable in some embodiments to have ground conductors within a column to be wider than the signal conductors. However, expanding the width of the ground conductors can increase the size of the electrical connector in a dimension along the column. In some embodiments, it may be desirable to limit the dimension of the electrical connector in a dimension along the columns of signal conductors. One approach to limiting the width of the connector is, as shown in FIG. 7A, to make mating contacts at an end of a column, such as mating contact $\mathbf{434}_1$, narrower than other mating contacts in the column, such as mating contact $\mathbf{434}_2$. The narrower mating contact $\mathbf{434}_1$ may otherwise be formed with the same shape as mating contact $\mathbf{434}_2$.

An alternative approach for reducing the size of the connector in a dimension along the columns of mating contacts is to offset the points of contacts for the dual beam mating contact portions. In the embodiment of FIG. 7A, the contact points are not offset. As shown, mating contact $\mathbf{434}_2$ has two beams $\mathbf{460}_7$ and $\mathbf{460}_8$. Each of these beams has a mating surface $\mathbf{722}_1$ and $\mathbf{722}_2$, respectively. When an electrical connector containing mating surfaces $\mathbf{722}_1$ and $\mathbf{722}_2$ is mated with a complementary connector, mating contact $\mathbf{434}_2$ will make contact with a mating contact in the complementary connector at mating surfaces $\mathbf{722}_1$ and $\mathbf{722}_2$. In the embodiment illustrated, the mating contact in the complementary connector is shown as ground conductor $\mathbf{530}_2$. In this embodiment, ground conductor $\mathbf{530}_2$ is shown as a blade, such as may be used in a backplane connector as described above in connection with FIG. 5. However, the shape of the mating contact is not a limitation on the invention.

As shown, mating surfaces $\mathbf{722}_1$ and $\mathbf{722}_2$ contact ground conductor $\mathbf{530}_2$ at contact points $\mathbf{710}_1$ and $\mathbf{710}_2$, respectively. For the contact configuration shown in FIG. 7A, contact points $\mathbf{710}_1$ and $\mathbf{710}_2$ are aligned in the direction of column C. To ensure that mating contact $\mathbf{434}_2$ makes reliable contact with ground conductor $\mathbf{530}_2$, ground conductor $\mathbf{530}_2$ may be constructed to have a width $W_1$ along the column. $W_1$ is larger than the width of mating contact $\mathbf{434}_2$ at the mating interface. This additional width ensures that, even with misalignment between a connector holding mating contact $\mathbf{434}_2$ and a connector holding ground conductor $\mathbf{530}_2$, both mating surfaces $\mathbf{722}_1$ and $\mathbf{722}_2$ will contact ground conductor $\mathbf{530}_2$.

In some embodiments, a mating contact having a width less than $W_1$ may be desired. FIGS. 7B and 7C illustrate alternative embodiments of a ground contact $\mathbf{434}_2$ that may be used with a mating ground conductor shaped as a blade like ground conductor $\mathbf{530}_2$ but having a width less than $W_1$. FIG. 7B shows a mating contact 750 that may be used in place of mating contact $\mathbf{434}_2$. In such an embodiment, mating contact 750 may form the mating contact portion of a wide ground conductor positioned between adjacent pairs of signal conductors in a daughter card wafer. However, the contact configuration illustrated in FIG. 7B may be used in connection with any suitable conductive element.

As with mating contact $\mathbf{434}_2$, mating contact 750 contains two beams $\mathbf{752}_1$ and $\mathbf{752}_2$, each providing a mating surface, $\mathbf{732}_1$ and $\mathbf{732}_2$, respectively. However, beams $\mathbf{752}_1$ and $\mathbf{752}_2$ are configured such that mating surface $\mathbf{732}_2$ is offset relative to mating surface $\mathbf{732}_1$ in a direction perpendicular to column C. When mating contact 750 engages ground conductor 730, mating surfaces $\mathbf{732}_1$ and $\mathbf{732}_2$ engage ground conductor 730 at contact points $\mathbf{734}_1$ and $\mathbf{734}_2$. Contact point $\mathbf{734}_2$ is offset in the direction O from contact point $\mathbf{734}_1$. As illustrated, the direction O is perpendicular to column C. Because of this offset in contact point $\mathbf{734}_1$ and $\mathbf{734}_2$, ground contact 730 may have a width $W_{1B}$ that is less than width $W_1$ of ground conductor $\mathbf{530}_2$.

In the embodiment of FIG. 7B, mating surface $\mathbf{732}_2$ is offset from mating surface $\mathbf{732}_1$ by forming beam $\mathbf{752}_2$ within beam $\mathbf{752}_1$. When a lead frame having a mating contact with a beam is incorporated into an electrical connector, the leading edge of the beam may be held within the connector housing in a way that the distal end of the beam is blocked from coming into contact with a conductive element in a mating conductor. Such a construction may avoid "stubbing" of the conductive element in the mating conductor on the beam, which can both prevent proper mating and damage the connector. With a mating contact as illustrated in FIG. 7B, the distal end of beam $\mathbf{752}_1$ may be mounted in a housing to prevent stubbing. The distal end of beam $\mathbf{752}_2$ may not be guarded by the housing. However, the configuration as shown positions the distal end of beam $\mathbf{752}_2$ behind distal portion 736 of beam $\mathbf{752}_1$, which prevents "stubbing" of ground conductor 730 on beam $\mathbf{752}_2$.

The embodiment of FIG. 7B is just one example of a configuration that may be used to form offset contact points. FIG. 7C shows an alternative embodiment. Mating contact 760 contains beams $\mathbf{762}_1$ and $\mathbf{762}_2$. The two beams provide two mating surface, $\mathbf{742}_1$ and $\mathbf{742}_2$. Beam $\mathbf{762}_2$ is shorter than beam $\mathbf{762}_1$, causing mating surface $\mathbf{742}_2$ to be offset from contact point $\mathbf{742}_1$. Accordingly, when mating contact 760 engages a mating contact in another connector, such as ground conductor 740, mating surfaces $\mathbf{742}_1$ and $\mathbf{742}_2$ engage ground conductor 740 at offset contact points $\mathbf{744}_1$ and $\mathbf{744}_2$. As shown, contact point $\mathbf{744}_2$ is offset from contact point $\mathbf{744}_2$ in direction O. As a result, ground conductor 740 may have a width $W_{1C}$ that is narrower than width $W_1$ of ground conductor $\mathbf{530}_2$ (FIG. 7A). Furthermore, because beam $\mathbf{762}_2$ is not fully contained within beam $\mathbf{762}_1$ as in the configuration of FIG. 7B, the distal end of beam $\mathbf{762}_1$ in the vicinity of mating surface $742_1$ may be narrower than the distal end of beam $752_1$ in the vicinity of mating surface $732_1$ (FIG. 7B). Accordingly, width $W_{1C}$ of ground conductor 740, in some embodiments, may be narrower than width $W_{1B}$ of ground conductor 730 (FIG. 7B). The embodiments of FIG. 7C may also be used in a manner that reduces stubbing. The distal end of beam $762_1$ may be guarded in a housing. The distal end of beam $742_2$ is guarded by portion 746, thereby preventing stubbing of ground conductor 740 on beam $742_2$.

In the embodiment illustrated in FIG. 7A, adjacent pairs of signal conductors along a column are separated by wide ground conductors that terminate in mating contacts, such as mating contact $434_2$. However, offset contact points as in the embodiments of FIGS. 7B and 7C may be used with other conductive elements. For example, some wafers, such as wafers 320B (FIG. 3) may have ground conductors at the end of a column that terminate in a narrower mating contact, such as mating contact $434_1$. These narrower grounds may have mating contacts with offset contact points. Likewise, the signal conductors in a pair may have mating contacts that also use multiple beams with offset contact points. Such an arrangement may allow narrower conductive elements for the signal conductors and/or narrow grounds in a mating connector. Accordingly, though FIGS. 7B and 7C illustrate offset points of contact only in connection with a wide ground conductor, similar approaches may be used in connection with mating contacts for conductive elements carrying signals or for narrow mating contacts for ground conductors.

Though electrical interconnection system 100 as described above provides a high speed, high density interconnection system with desirable electrical properties, other features may be incorporated to provide even greater density or otherwise provide performance characteristics that are desirable in some embodiments.

Figure 8B:
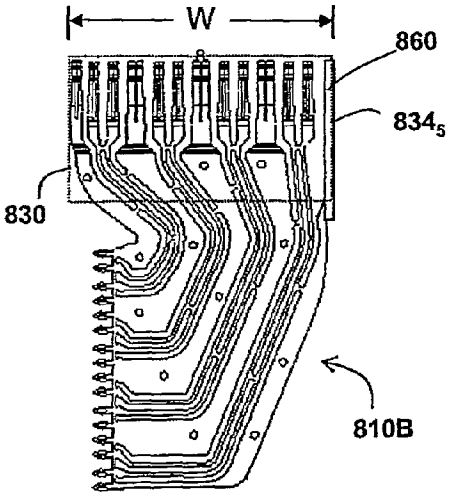
FIG. 8B is a sketch of a portion of the lead frame of FIG. 8A in a subsequent manufacturing step.
Figure 8A:
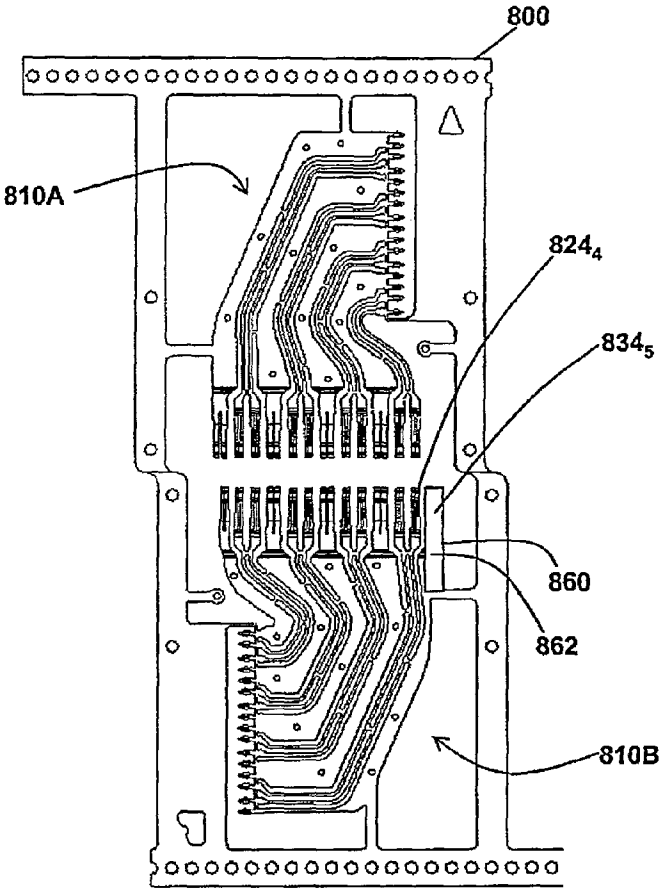
FIG. 8A is a plan view of a lead frame used in the manufacture of a connector according to some embodiments of the invention.

FIGS. 8A and 8B illustrate a lead frame 800 that may be used in place of a lead frame 400 in forming wafers in a daughter card connector. In the embodiment illustrated in FIG. 8A, lead frame 800 includes wafer strip assemblies 810A and 810B, each of which may be used to form a different type of wafer. Here, wafer strip assembly 810A has the same shape as wafer strip assembly 410A (FIG. 4A).

Wafer strip assembly 810B has a shape similar to that of wafer strip assembly 410B (FIG. 4A). However, wafer strip assembly 810B differs in the shape of the mating contact of the outermost ground conductor in the column of mating contacts formed by the conductive elements of wafer strip assembly 810B. In the embodiment illustrated in FIG. 4A, the outermost ground mating contact $434_5$ is shaped as a dual beam contact. Though dual beam contact $434_5$ is shown to be narrower than other ground mating contacts, such as ground mating contacts $434_2$. In contrast, as illustrated in FIG. 8A, a mating contact $834_5$ may be stamped as a generally planar member. The generally planar member has an upper surface 862 and an edge 860.

FIG. 8B shows the wafer strip assembly 810B at a subsequent stage of manufacture. In this stage, wafer strip assembly 810B has been formed to be perpendicular to the original surface of the sheet of metal from which lead frame 800 is stamped. Accordingly, in FIG. 8B, edge 860 is visible, but surface 862, which is perpendicular to edge 860, is not visible.

FIG. 8B illustrates a manner in which forming a ground contact in this fashion may increase the density of a connector. Superimposed on the wafer strip assembly 810B in FIG. 8B is an outline of front housing portion 830. As can be seen, front housing portion 830 has a width $W_8$ that extends to the outwardly facing surface of ground mating contact $834_5$, leaving an outwardly facing surface of ground mating contact $834_5$ exposed in an outwardly facing surface of a front housing portion 830. Accordingly, in contrast to a housing that may be used to enclose mating contacts as in FIG. 4A, there is no need for front housing portion 830 to extend beyond the outermost conductor in a column.

As a result, the width $W_8$ of front housing portion 830 can be less than the width of a front housing portion that would be required to contain the mating contact portions of a wafer strip assembly such as wafer strip assembly 410B (FIG. 4A). Though the width of front housing portion 830 may be less than that required to enclose a wafer strip assembly 410B, pairs of signal conductors in wafer strip assembly 810B are nonetheless bounded on either side across the column by a ground contact. Specifically, the longest pair of signal conductors $824_4$ is bounded on either side by a ground contact, creating the same ground environment around pair $824_4$ as is around the pair of signal conductors $424_4$ (FIG. 4A).

Figure 11:
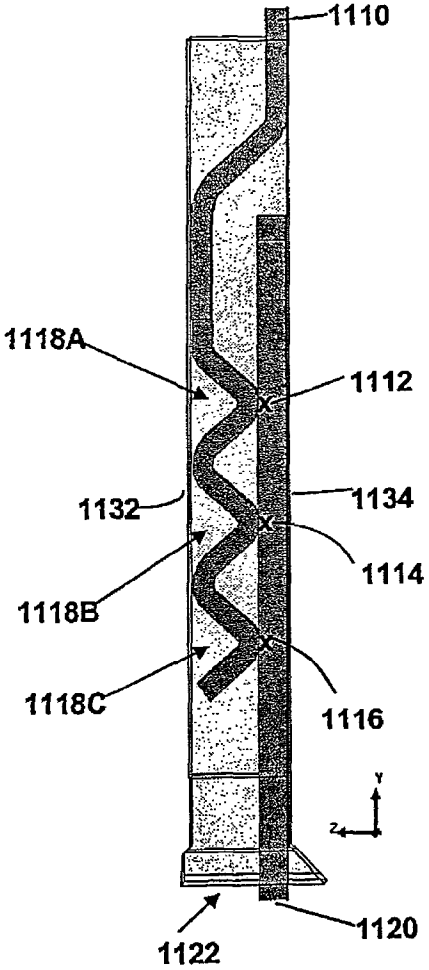
FIG. 11 is a sketch of the mating contact portions of conductive elements of mating connectors according to some embodiments of the invention.

Reducing the column width while maintaining electrical properties improves density of a high speed connector. For example, FIG. 8B illustrates a four pair connector. If reducing the amount of space occupied by the mating contact portion of the outermost ground conductor allows an additional pair to be placed in the column, greater density is achieved by allowing more signal conductors per unit length along an edge of a daughter card 140 (FIG. 11).

Figure 9B:
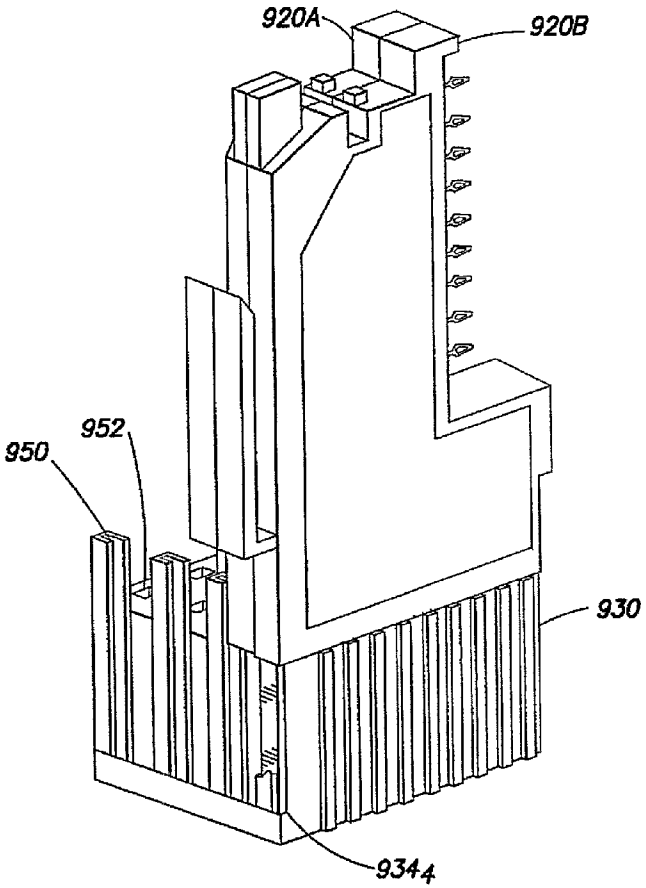
FIG. 9B is a sketch of the pair of wafers of FIG. 9A mounted in a front housing portion.
Figure 9A:
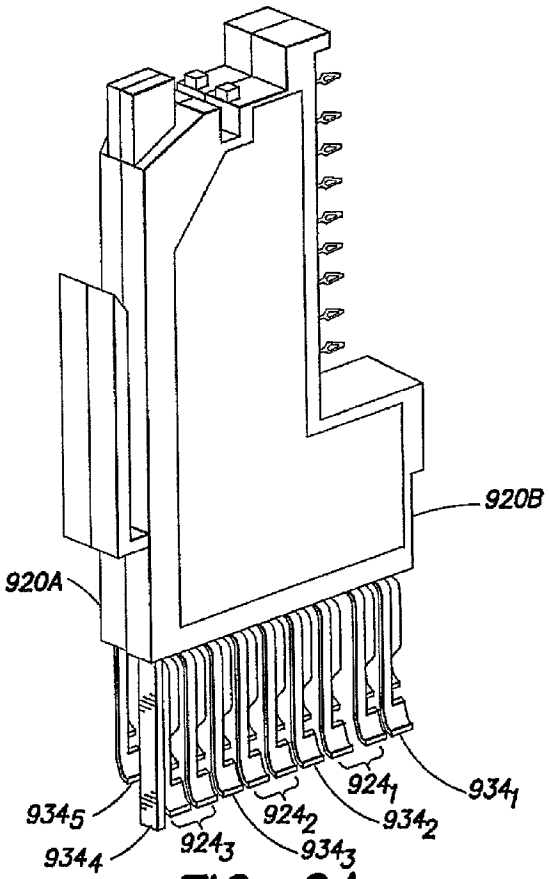
FIG. 9A is a sketch of a pair of wafers that may be used in the manufacture of a connector according to some embodiments of the invention.

FIG. 9A illustrates a wafer formed using an outer ground mating contact generally of the shape of ground mating contact $834_5$. In the embodiment illustrated in FIG. 9A, a three pair connector is illustrated. Additionally, both signal and ground conductors include mating contact elements generally as in FIG. 7C, which may further reduce the length of a column. Here, pairs $924_1$, $924_2$ and $924_3$ form three pairs of signal conductors in a column of conductive elements in a wafer 920B. Ground mating contacts $934_1$, $934_2$, $934_3$ and $934_4$ are also included in the column, such that each pair is positioned between an adjacent two of the ground mating contacts.

A second wafer, wafer 920A is shown aligned with wafer 920B. In the embodiment illustrated, the column of mating contacts in wafer 920B ends with a planar ground mating contact $934_4$ adjacent the longest pair of signal conductors, which in this example is the pair $924_3$. A similar planar mating contact need not be included at the end of the column of mating contacts of wafer 920A. Rather, in the embodiment illustrated, the last mating contact in the column formed of mating contacts in wafer 920A is ground mating contacts $934_5$. Because adjacent wafers, such as wafers 920A and 920B, have different configurations of signal and ground conductors, the ground conductor in wafer 920A may have a different position in the column direction than ground mating contact $934_4$ such that it will fit within a volume having an outermost surface coincident with ground mating contact $934_4$ even though ground mating contact $934_5$ is wider in the column direction than ground mating contact $934_4$.

FIG. 9B illustrates how wafers with mating contact portions as illustrated in FIG. 9A may be integrated into a connector. FIG. 9B shows front housing 930. As described above, a front housing may be formed of an insulative material, with or without lossy portions or other shielding components. In the embodiment illustrated, front housing 930 is molded of a dielectric material, such as plastic.

Front housing 930 is molded with slots 950 along an outer side. Columns of cavities 952 are molded in the interior of front housing 930. Each of the cavities 952 passes from the top surface to the bottom surface of front housing 930 in the orientation pictured in FIG. 9B. Each of the cavities 952 is shaped to receive a mating contact, such as ground mating contacts $934_1$, $934_2$, $934_3$, or $934_5$ or a signal conductor of a pair, such as pairs $924_1$, $924_2$ or $924_3$. Though the mating contact portions within cavities 952 are not visible in FIG. 9B, they are exposed through openings in the bottom surface of front housing 930. Though those openings, mating contacts from conductive elements in a mating connector can enter cavities 952 to make electrical connection to the mating contacts from wafers 920A and 920B.

Each slot 950 is shaped to receive a mating contact portion, such as ground mating contact $934_4$. Accordingly, when wafers 920A and 9208 are inserted into front housing 930, the mating contact portions of the conductive elements in wafers 920A and 920B occupy two columns of cavities 952 and a slot 950. Other wafer pairs may be similarly inserted into front housing 930, creating a connector of any desired length.

In the illustrated embodiment, ground mating contact $934_4$ is exposed in a sidewall of front housing 930. A connector designed to mate with a connector formed using the module illustrated in FIG. 9B may have a corresponding ground mating contact positioned to mate with ground mating contact $934_4$ outside of front housing 930. An example of such a connector is provided in FIGS. 10A, 10B and 10C illustrate a suitable backplane module.

Figure 10A:
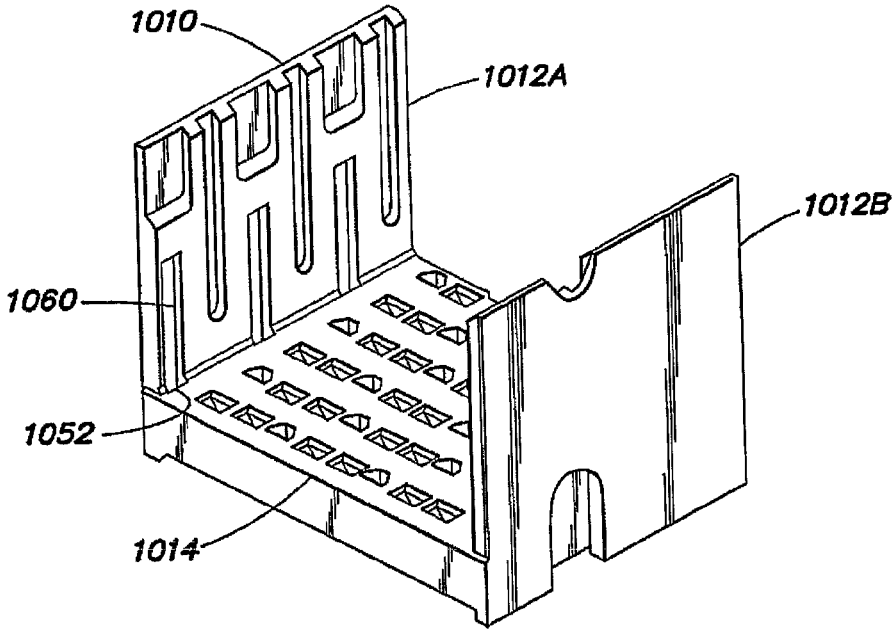
FIG. 10A is a sketch of a housing for a connector adapted to mate with the connector of FIG. 9B.
Figure 10B:
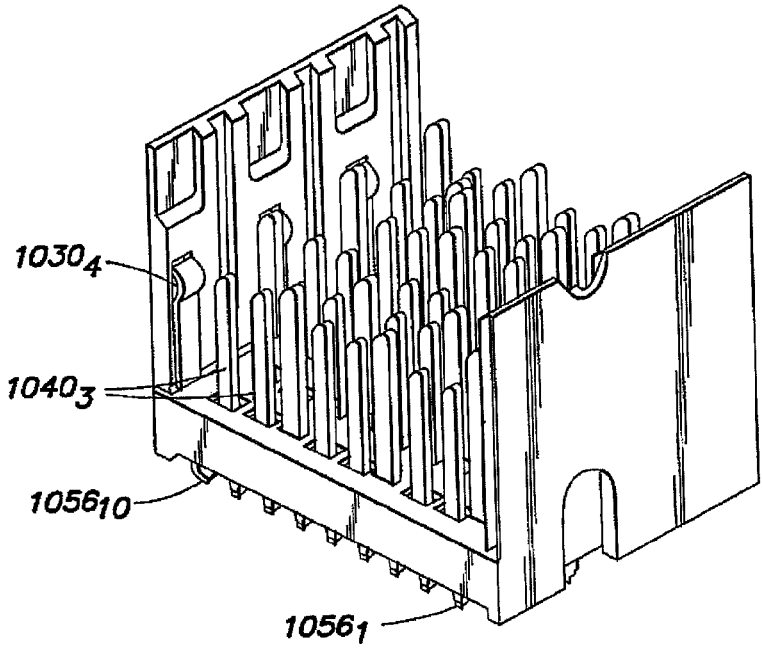
FIG. 10B is a sketch of the housing of FIG. 10A at a later stage of manufacture in which conductive elements have been installed in the housing.
Figure 10C:
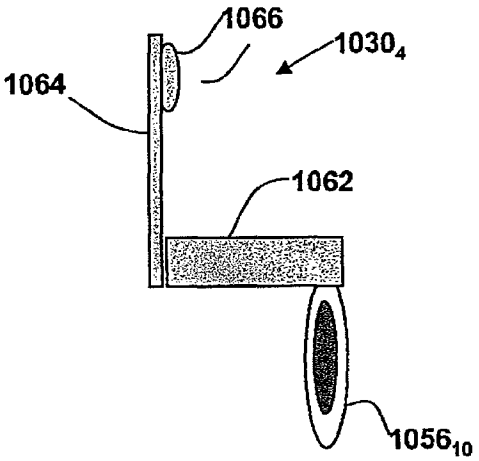
FIG. 10C is a sketch of a conductive element that may be inserted in the housing of FIG. 10A.

FIG. 10A illustrates a shroud 1010 for forming such a backplane module. Shroud 1010 may be constructed in the same fashion as shroud 510 (FIG. 5A). However, any suitable materials or construction techniques may be used. As illustrated in FIG. 10A, shroud 1010 includes opposing sidewalls 1012A and 1012B. Shroud 1010 also includes a floor 1014. Floor 1014 includes openings through which contact elements may be inserted, either from above or below floor 1014. FIG. 10B shows shroud 1010 with conductive elements inserted. As can be seen in FIG. 10B, the conductive elements are arranged in columns and may be shaped as blades, providing mating contact surfaces, generally as illustrated in FIGS. 6A-6C.

Additionally, shroud 1010 may include a sidewall slot 1060 (FIG. 10A) adapted to receive a conductive element for mating with ground mating contacts, such as $934_4$ exposed in an outer surface of housing 930. Because, in the embodiment illustrated, every other column of conductive elements ends in a planar ground mating contact such as $934_4$, backplane shroud 1010 includes a slot 1060 for every two columns of conductive elements.

As illustrated, slot 1060 may communicate with an opening 1052 through floor 1014 of shroud 1010. As a result, a contact element inserted in slot 1060 may have a mating contact portion above floor 1014 and a contact tail below floor 1014. As illustrated in the example of FIG. 10B, a conductive element $1030_4$ may be inserted into a slot 1060 through opening 1052. Conductive element $1030_4$ may have a contact tail $1056_{10}$. Contact tail $1056_{10}$ may be aligned in a column with contact tails, such as contact tail $1056_1$, of other conductive elements in a column oriented to mate with the conductive elements in one column of a daughter card connector.

Conductive element $1030_4$ is positioned adjacent pair $1040_3$ that may be designated as a signal conductor pair. Accordingly, the relative positioning of ground and signal conductors may be carried through the mating interface formed when a connector, such as may be formed using a module as illustrated in FIG. 9B, is mated with a connector formed using a module such as is illustrated in FIG. 10B.

FIG. 10C illustrates a conductive element $1030_4$ and that may be inserted into shroud 1010. In the example illustrated, conductive elements $1030_4$ has a contact tail, here illustrated as compliant section $1056_{10}$. At an opposing end, conductive elements $1030_4$ includes a mating contact portion, here shaped as beam 1064. Beam 1064 may be shaped to fit within slot 1060. When the connector module of FIG. 10B is not mated to another connector, a contact surface 1066 on a distal end of beam 1064 will extend out of slot 1060. In this position, contact surface 1066 can make contact with a planar ground mating contact $934_4$ when a connector module such as is illustrated in FIG. 9B is inserted.

Beam 1064 generates a spring force that presses mating contact surface 1066 against planar ground mating contact $934_4$. To facilitate generation of such a spring force, slot 1060 may be sized to provide a clearance that allows beam 1064 to move within slot 1060.

To provide electrical coupling between ground mating contact $934_4$ and structures in a substrate coupled to contact tail $1056_{10}$, beam 1064 is coupled to contact tail $1056_{10}$ through an intermediate portion 1062. In the embodiment illustrated in FIG. 10B, conductive element $1030_4$ may be inserted into shroud 1010 from below such that intermediate portion 1062 is inserted in a slot (not shown) within floor 1014. Retention features may be included on intermediate portion 1062 to hold conductive element $1030_4$ to shroud 1010.

Turning to FIG. 11, an alternative approach for increasing the density of a high speed connector is illustrated. FIG. 11 illustrates an alternative configuration for a mating contact portion, referred to herein as a "wavy" mating contact. Here, "wavy" refers to the structure created from multiple bends or folds transverse to the longitudinal dimension of the mating contact that alternate in direction along the length of the mating contact. The bends or folds provide a corrugated, or "wavy," appearance. As described in greater detail below, each wavy contact may be relatively narrow, allowing spacing between conductive elements to be decreased while still providing desirable electrical and mechanical properties.

The wavy mating contact configuration of FIG. 11 may be used with either signal or ground conductors or, in some embodiments, both. It may be used instead of any of the mating contact configurations illustrated in FIG. 7A, 7B or 7C. Though, in some embodiments, the wavy contact configuration of FIG. 11 may be used in a connector that includes some conductive elements using a wavy contact configuration in combination with one or more other conductive elements that use one or more of the mating contact configurations illustrated in FIGS. 7A, 7B and 7C. In some embodiments, a daughter card connector will include a front housing as illustrated in FIG. 9B with a ground mating contact portion embedded in an exterior surface of housing. Mating contact portions within the housing will be wavy contacts.

FIG. 11 illustrates a wavy mating contact 1110 engaged with a mating contact 1120. Mating contact 1110 may be a portion of a signal conductive element or a ground conductive element. Though not shown in FIG. 11, such a conductive element may have an intermediate portion and a contact tail for engagement to a printed circuit board or other substrate. In the embodiment illustrated, mating contact 1110 is a mating contact of a conductive element in a daughter card connector. However, mating contact 1110 is described as a portion of a daughter card connector as an example and not a limitation. A mating contact as illustrated in FIG. 11 may be used in any suitable connector.

Mating contact 1120 may be a portion of a conductive element in a connector adapted to mate with a connector containing mating contact 1110. In the exemplary embodiment pictured, mating contact 1120 is a blade in a back plane connector, such as illustrated in FIG. 5A or 10B. However, mating contact 1120 may be a portion of any suitable connector. It should be appreciated that, for simplicity, FIG. 11 shows only a single set of mating contacts that may exist in two mating electrical connectors. Mated connectors may contain any number of conductive elements, which may be disposed in multiple rows and/or columns such that the illustrated structure may be repeated in an electrical connector.

As shown in FIG. 11, mating contact 1110 and 1120 engage within a cavity 1122. Cavity 1122 may be a cavity in a front housing of a connector, such as a cavity 952 in a front housing 930 (FIG. 9B). In the embodiment illustrated, the front housing is formed of an insulative material and therefore has insulative walls such that the mating contacts may be placed adjacent to the walls or even press against them without creating an electrical short.

In the embodiment illustrated in FIG. 11, mating contact 1110 may be formed from a single elongated conductive member, such as may be stamped from a sheet of metal. Multiple points of contact are provided between mating contact 1110 and mating contact 1120 because of a "wavy" shape to mating contact 1110 provided by curved segments, each of which has an inflection point that provides a contact region. Here, three points of contact, 1112, 1114 and 1116 are illustrated. Three points of contact are formed in this example because mating contact 1110 includes three curved segments 1118A, 1118B and 1118C. Each curved segment contains an inflection point. The tangent to a surface of mating contact 1110 facing mating contact 1120 at each of these inflection points changes direction, creating an exposed surface at each of the contact points 1112, 1114 and 1116. These exposed surfaces in these contact regions may be formed to improve their effectiveness as contact regions. For example, they may be plated with gold or other soft metal and/or other compound that is conductive and resists oxidation. Alternatively, each inflection point may be formed with a dimple or other narrowed structure that concentrates contact force over a relatively small area, which can aid in forming a reliable electrical connection.

Here, mating contact 1110 is shaped to provide three contact points. However, any suitable number of contact points may be provided. For example, in some embodiments, two contact points may be provided by having only two curved segments along the length of mating contact 1110. Conversely, more than three contact points may be provided by providing more than three curved segments along the length of mating contact 1110.

In the embodiment of FIG. 11, contact force at contact points 1112, 1114 and 1116 is provided by compression of mating contact 1110. As can be seen, the mating contacts 1110 and 1112 are constrained within cavity 1122. Mating contact 1110 is adjacent to and constrained by wall 1132 of cavity 1122. Mating contact 1120 is positioned along and constrained by wall 1134 of cavity 1122. In an embodiment in which the mating contacts are positioned within a front housing, such as front housing 930 (FIG. 9B), the walls 932 and 934 may be formed of the insulative material used to mold front housing 930. Though, such walls may be formed in any suitable way.

Figure 12A:
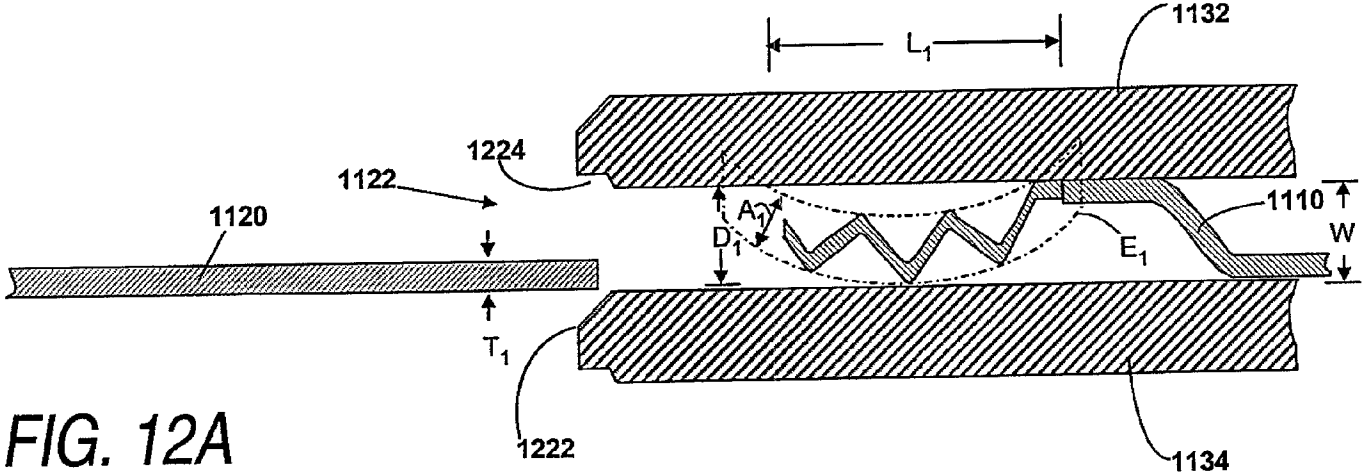
FIGS. 12A, 12B and 12C illustrate the mating contact portions of FIG. 11 at various stages of a mating sequence.
Figure 12B:
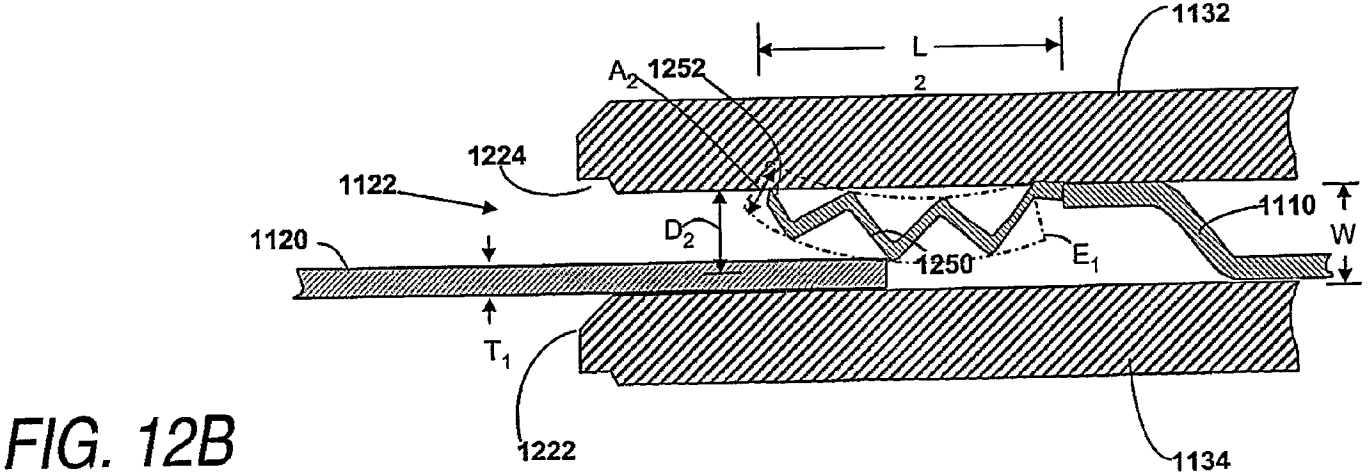
Figure 12C:
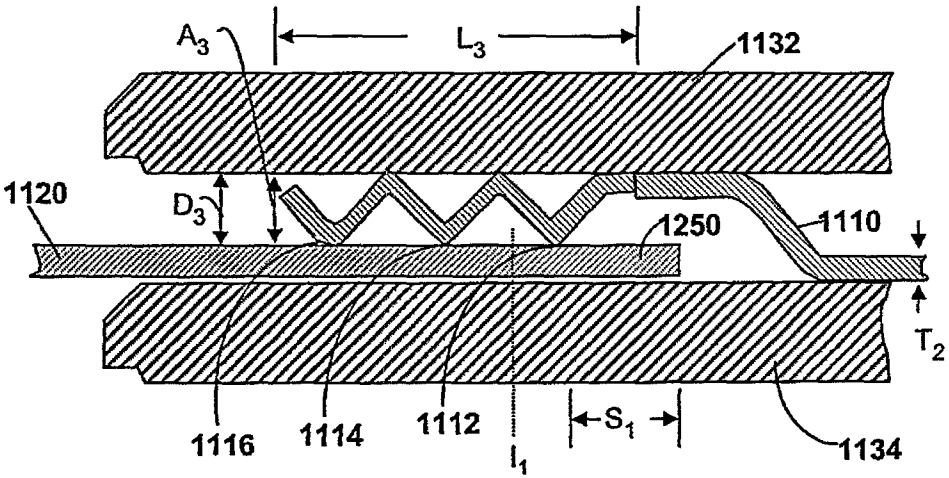

FIGS. 12A, 12B and 12C illustrate a mating sequence that demonstrates a manner in which a contact force may be generated at each of the contact points, such as 1112, 1114 and 1116. FIG. 12A shows mating contacts 1110 and 1112 when aligned for mating. Walls of cavity 1122 may be shaped to facilitate this alignment. For example, wall 1134 is shown with a tapered surface 1122 and wall 1132 is shown with a tapered surface 1224. These tapered surfaces are oriented to direct mating contact 1120 into engagement with mating contact 1110. Mating contacts 1110 and 1120 may both be portions of connectors in an interconnection system. Additionally, both the interconnection system and the connectors may contain alignment mechanisms, such as guide pins (not shown), as are known in the art, to aid in alignment of mating contacts 1110 and 1120 in the position illustrated.

Prior to mating as illustrated in FIG. 12A, mating contact 1110 has a "wavy" portion that extends a distance $D_1$ from wall 1132. In the embodiment illustrated, the distance $D_1$ can be increased by forming mating contact 1110 with a generally curved shape. As shown, mating contact 1110 has a curved envelope $E_1$, defined by the amplitude $A_1$ of the waves. Here, the amplitude is indicated as the distance between the maxima and minima, as defined by the distance between inflection points in a direction normal to the surface of the contact at the inflection points. Additionally, the distance D1 can be increased by providing a general tilt relative toward wall 1132.

Mating contact 1120 has a thickness $T_1$ such that the distance $D_1$ plus the thickness $T_1$ exceeds the width W of cavity 1122. Accordingly, when mating contact 1120 is inserted into cavity 1122 as illustrated in FIG. 12B, it will press the wavy portion of mating contact 1110 towards wall 1132.

As the mating sequence between a mating contact 1110 and a mating contact 1120, as illustrated in FIG. 12B, mating contact 1120 slides relative to mating contact 1110. Mating contact 1120 initially engages a tapered surface 1250 of mating contact 1110. In this embodiment, tapered surface 1250 is formed from a curved segment that forms wavy contact 1110. As mating contact 1120 presses against tapered surface 1250, it deflects mating contact 1110 towards wall 1132.

As the distal end of mating contact 1110 is deflected towards wall 1132, mating contact 1110 may maintain its curved shape as illustrated in FIG. 12A. Though, depending on the relative size and shape of the segments of mating contact 1110, the shape of mating contact may change. Either or both of the general curvature of the mating contact 1120 and the amplitude of the wavy segments may change. Additionally, the tilt angle of mating contact 1110 may decrease. Accordingly, FIG. 12B illustrates that after engagement between mating contacts 1110 and 1120, mating contact portion 1120 has a curved envelope $E_2$, which may have a larger radius of curvature than envelope $E_1$. Additionally, the amplitude of some or all of the curved segments may decrease to $A_2$ and the wavy contact structure may be pressed towards wall 1132 such that the tilt angle has decreased.

Regardless of whether mating contact 1110 initially changes shape, as mating contact 1120 is pressed further in the elongated direction of mating contact 1120, it will slide further along tapered surface 1150, pressing mating contact 1110 towards wall 1132. When a portion of mating contact 1110 is pressed against wall 1132, the shape of mating contact 1110 will change or change further. In the embodiment in which mating contact 1110 has a generally curved shape, the distal portion 1252 will initially make contact with wall 1132.

When distal portion 1252 makes contact with wall 1132, the curve in mating contact 1110 will be flattened as mating contact 1110 is pressed against wall 1132. FIG. 12C illustrates mating contact 1110 when the curve in mating contact 1110 has been flattened by pressing mating contact 1110 against wall 1132.

As can be seen by the progression of shapes shown in FIGS. 12A, 12B and 12C, before mating contacts 1110 and 1120 engage, mating contact 1110 extends from wall 1132 by a distance $D_1$. The wavy distal end of mating contact 1120 has a length $L_1$. As mating contact 1120 engages tapered surface 1250, a camming force is generated normal to wall 1132. This force deflects the distal end of mating contact 1110 towards wall 1132. Accordingly, in the state illustrated in FIG. 12B, mating contact 1110 extends from wall 1132 by a maximum amount of $D_2$. The force that reduces that curvature of the wavy end of mating contact 1110 may also tend to elongate the contact. Accordingly, the wavy distal end of mating contact 1110, in the state illustrated in FIG. 12B, has a length $L_2$. $L_2$ may be longer than length $L_1$.

As the mating sequence proceeds and mating contact 1120 slides further along mating contact 1110, additional force normal to wall 1132 may be generated. This force will continue to reduce the curvature in the wavy portion of mating contact 1110. FIG. 12C illustrates an embodiment in which mating contacts 1110 and 1120 are sized relative to the width, W, of cavity 1122 such that when mating contact 1120 has been fully inserted, the wavy portion of mating contact 1110 is compressed between mating contact 1120 and wall 1132.

In this state, the inflection points on the upper surface of wavy contact 1110 press against wall 1132 such that the distal wavy end of mating contact 1110 is no longer curved. Moreover, the wavy contact portion may be pressed against wall 1132 such that the amplitude of the waves in wavy contact 1110 is reduced. For example, FIG. 12C shows that, when mated, the amplitude of the waves has decreased to $A_3$. Amplitude A3, in the embodiment illustrated, is also defined the distance $D_3$ between wall 1132 and the furthest point on mating contact 1132. As illustrated, distance $D_3$ may be less than the amplitude $A_1$ of the waves in wavy contact 1110 in an uncompressed state as illustrated in FIG. 12A. The compression of the wavy distal end of mating contact 1110 may further elongate the wavy portion, resulting in a length $L_3$ when the mating contacts 1110 and 1120 are fully engaged.

The compression of wavy contact 1110 also generates contact force between each of the contact regions of wavy contact 1110 and mating contact 1132.

Mating contact 1110 may be constructed of a material that provides suitable electrical and mechanical properties. For example, mating contact 1110 may be stamped from a material having a width and thickness that provides a desired contact force. For example, the thickness $T_2$ may be on the order of 10 mills or less. In some embodiments the thickness may be approximately 8 mills or less. The length $L_1$ of the wavy portion of mating contact 1110 may be selected to provide a desired number of points of contact. For example, length $L_1$ may be between 2 mm and 10 mm. In some embodiments, the length may be approximately 4 mm. However, any suitable length may be used.

Mating contact 1120 may be formed to have any suitable dimensions. However, FIGS. 12A and 12B illustrate dimensions that may be selected to provide desirable electrical properties. One way in which desirable electrical properties may be provided is through the reduction of contact wipe that can lead to a stub that is undesirable for high frequency operation. When mating contacts 1110 and 1120 are mated, a portion of mating contact 1120 may extend beyond contact point 1112. Such a portion, here illustrated as stub 1250, extends an amount $S_1$ beyond contact point 1112. Such a configuration may be desirable because it ensures contact between mating contact 1110 and 1120 at all intended contact points, even if slight misalignments or component tolerances preclude mating contact 1120 from extending as far into cavity 1122 as intended based on the designs of the connectors holding mating contacts 1110 and 1120. Though such a stub is undesirable for electrical performance reasons, a stub is designed into a conventional connector to ensure that the mating contacts in mating connectors will adequately mate despite misalignment or variations of component dimensions associated with manufacturing tolerances that change the relative positions of the mating contacts. The designed in stub length may also be described as the contact "wipe." The designed in stub length may in some scenarios be inferred from an average stub length across a connector or, is some scenarios, across multiple samples of connectors manufactured according to a production process.

However, in an embodiment with a wavy contact that provides multiple points of contact disposed along the direction of relative motion of the mating contact portions during mating (here the elongated dimension of the mating contacts), the nominal or designed stub length $S_1$ may be reduced relative to a conventional connector because the consequences of misalignment of mating contacts 1110 and 1120 are not as significant as in a connector with a conventional contact design. For example, if mating contact 1120 were inserted into cavity 1122 only to point $I_1$, mating contacts 1110 and 1120 would not engage at contact point 1112. However, adequate contact would be made at contact points 1114 and 1116. Thus, two points of contact would still be provided, ensuring a reliable electrical connection such that operation of the connector does not fail. Accordingly, the stub length $S_1$ may be designed to be shorter to improve the overall electrical performance without a significant impact on contact reliability. For example, the wipe may be less than 2 mm. In some embodiments, the wipe may be less than 1.5 mm. In some embodiments, the wipe may be 1.1 mm or less, such as 0.8 mm or 0.5 mm in some embodiments. A shorter designed stub length $S_1$ leads to less variation in performance of the connector. For example, when multiple connectors with a design having a stub length as pictured in FIG. 12C were analyzed, the variance of the impedance through the connector was on the order of +/−6 Ohms relative to a design goal of 100 Ohms. Some amount of variation is inherent in a connector because of manufacturing tolerances. However, the level of variation of a connector of a conventional design with similar manufacturing tolerances may be about +/−14 Ohms.

A further design element that may impact electrical performance of the mating contact portion is also illustrated in FIGS. 12A, 12B and 12C. By forming mating contact 1110 from a single elongated member, rather than, for example, two beams as illustrated in FIG. 7A, the width of the mating contact may be reduced. The width of mating contact 1120 may have a corresponding reduction. Reducing the width of the mating contacts in this fashion may increase the impedance in the mating contact region relative to a conventional electrical connector. To maintain a desired impedance, the thickness $T_1$ of mating contact 1120 may be increased. For example, thickness $T_1$ may be greater than 8 mills. In some embodiments, the thickness may be between 8 and 15 mills and, in some embodiments may be 10 mills or 12 mills. In contrast, the thickness $T_2$ of mating contact 1110 may be less. In some embodiments, the thickness $T_2$ may be approximately 8 mils.

Figure 13:
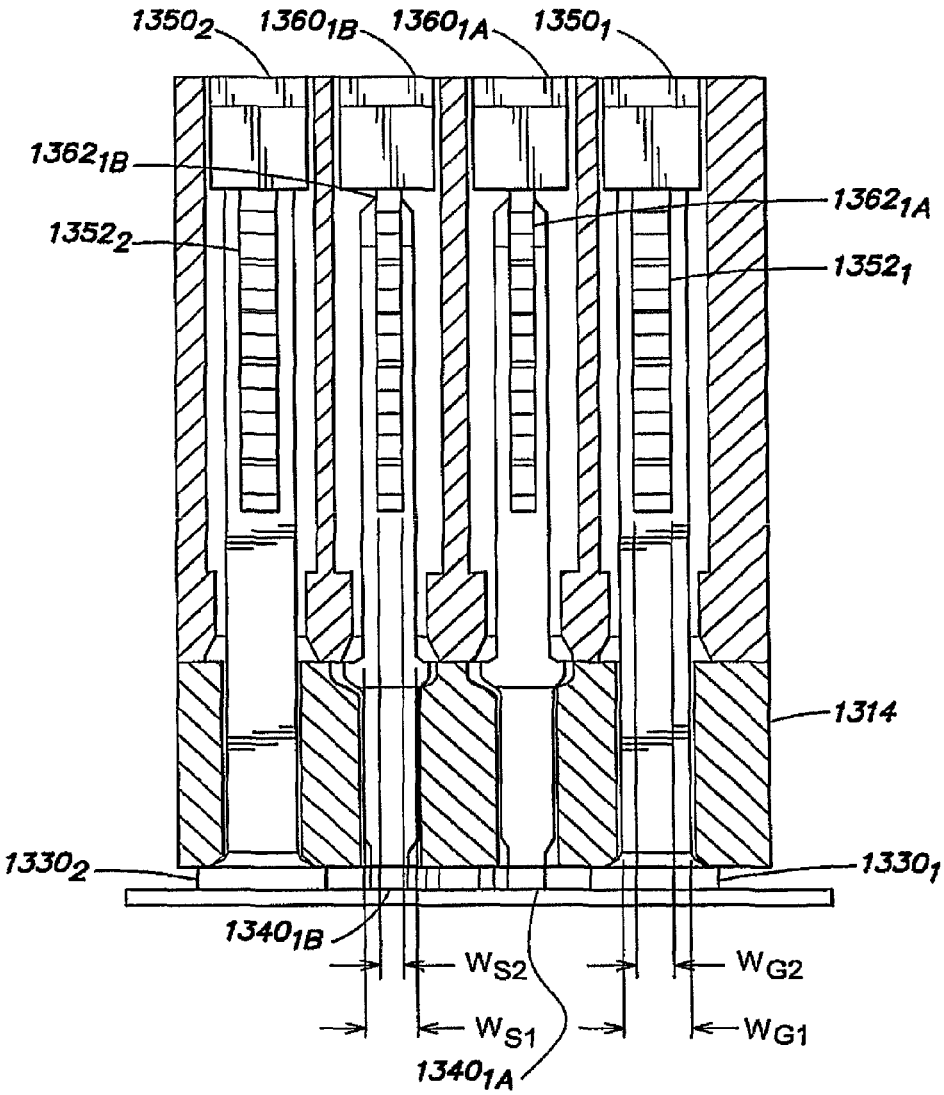
FIG. 13 is a cross-sectional view of a portion of an electrical connector from an orientation perpendicular to the orientation of the cross-section of FIG. 12B.

FIG. 13 illustrates other dimensions of an electrical connector with wavy mating contact portions. FIG. 13 illustrates mating contact portions of conductive elements from a top view in which wavy mating contact portions can be seen overlaying planar contacts to which they mate. Here, a pair of signal conductor elements $\mathbf{1360}_{1A}$ and $\mathbf{1360}_{1B}$ is shown. On either side of the pair is a ground conductor element $\mathbf{1350}_1$ and $\mathbf{1350}_2$. Ground conductor elements $\mathbf{1350}_1$ and $\mathbf{1350}_2$ in signal conductor elements $\mathbf{1360}_{1A}$ and $\mathbf{1360}_{1B}$ each may occupy one position in a column, such as may be implemented in a wafer of a daughter card assembly.

As illustrated, each of the ground conductive elements $\mathbf{1350}_1$ and $\mathbf{1350}_2$ and each of the signal conductive elements $\mathbf{1360}_{1A}$ and $\mathbf{1360}_{1B}$ contains a wavy mating contact, illustrated as wavy contacts $\mathbf{1352}_1$ and $\mathbf{1352}_2$ associated with ground conductive elements $\mathbf{1350}_1$ and $\mathbf{1350}_2$, respectively and wavy mating contacts $\mathbf{1362}_{1A}$ and $\mathbf{1362}_{1B}$ associated with signal conductive elements $\mathbf{1360}_{1A}$ and $\mathbf{1360}_{1B}$, respectively. Each of the wavy mating contacts may be shaped generally as in FIG. 11 to provide multiple points of contact with an associated mating contact from a mating connector. For example, wavy mating contact $\mathbf{1352}_1$ makes multiple points of contact along conductive element $\mathbf{1330}_1$. Wavy mating contact $\mathbf{1362}_{1A}$ makes multiple points of contact along the length of conductive element $\mathbf{1340}_{1A}$. Wavy mating contact $\mathbf{1362}_{1B}$ makes multiple points of contact along the length of conductive element $\mathbf{1340}_{1B}$ and wavy mating contact $\mathbf{1352}_2$ makes multiple points of contact along the length of conductive element $\mathbf{1330}_2$.

From the orientation of FIG. 13, it can be seen that each of the wavy mating contacts may be shaped as an elongated member. Because, in some embodiments, contact force may be generated, at least partially, by compression of the wavy member, each of the wavy mating contacts can have a relatively small width. Here, each of the wavy mating contacts associated with a signal conductive element has a width $W_{S2}$. The width $W_{S2}$ may be less than 0.5 millimeters. In some embodiments, the width may be approximately 0.4 millimeters. As can be seen in FIG. 13, this width is less than the width of the intermediate portions of the conductive elements.

As shown, each of the wavy mating contacts mates with a generally planar member, here formed as blades of a backplane connector. To ensure proper connection despite misalignment or variations associated with manufacturing tolerances, the planar members may be wider than the wavy mating contacts. Accordingly, FIG. 13 illustrates that signal conductive elements $\mathbf{1340}_{1A}$ and $\mathbf{1340}_{1B}$ have a mating contact portion with a width $W_{S1}$, which is slightly wider than width $W_{S2}$. The width $W_{S1}$ may be on the order of 0.6 millimeters. Though, connectors may be constructed with conductive elements of any suitable dimensions. Nonetheless, the relatively compact nature of the wavy mating contacts allows the signal conductors to be placed relatively close together. In some instances, the signal to signal spacing along a row with spacing on center between signal conductive element $\mathbf{1360}_{1A}$ and signal conductive element $\mathbf{1360}_{1B}$, on the order of 1.5 millimeters or less. In some embodiments, the spacing may be 1.35 millimeters or 1.3 millimeters.

In some embodiments, ground conductive elements, such as ground conductive elements $\mathbf{1350}_1$ and $\mathbf{1350}_2$ may have the same dimensions and spacing relative to adjacent conductive elements as the signal conductive elements $\mathbf{1360}_{1A}$ and $\mathbf{1360}_{1B}$. However, in the embodiment illustrated, the ground conductive elements are shown to have slightly wider mating contacts $\mathbf{1352}_1$ and $\mathbf{1352}_2$ than the mating contacts $\mathbf{1362}_{1A}$ and $\mathbf{1362}_{1B}$ of the signal conductive elements $\mathbf{1360}_{1A}$ and $\mathbf{1360}_{1B}$. Providing wider ground conductive elements may improve the signal integrity. Here each of the wavy mating ground contacts has a width $W_{G2}$, which may, in some embodiments, be approximately 0.6 millimeters. Though, any suitable dimension may be used.

As with the signal conductive elements, the planar portion of the mating conductive elements may be wider than the wavy mating contact. Accordingly, FIG. 13 illustrates that conductive element $\mathbf{1330}_1$ has a width $W_{G1}$. For example, width $W_{G1}$ in some embodiments may be 0.8 millimeters or, in other embodiments, 1.0 millimeters. Such a width may allow a center to center spacing between a signal conductive element, such as $\mathbf{1360}_{1A}$ and an adjacent ground conductive element, such as ground conductive element $\mathbf{1350}_1$ to be on the order of 1.5 millimeters or less. In the embodiment illustrated, the spacing may be approximately 1.3 millimeters.

In the embodiment of FIG. 13, uniform center to center spacing is provided between each of the conductive elements within a column. However, other configurations are possible. For example, wavy mating contacts $\mathbf{1362}_{1A}$ and $\mathbf{1362}_{1B}$ for signal conductive elements $\mathbf{1360}_{1A}$ and $\mathbf{1360}_{1B}$ need not be separated with the same center line to center line spacing as is used for positioning the rest of signal conductive elements $\mathbf{1360}_{1A}$ and $\mathbf{1360}_{1B}$. As one example, wavy mating contacts $\mathbf{1362}_{1A}$ and $\mathbf{1362}_{1B}$ could be formed to provide a smaller center line to center line spacing than in other regions of signal conductive elements $\mathbf{1360}_{1A}$ and $\mathbf{1360}_{1B}$. Smaller spacing may provide tighter electrical coupling, which may reduce susceptibility to noise or provide a different signal impedance than if the uniform spacing illustrated in FIG. 13 were employed.

Further, it should be appreciated that FIG. 13 illustrates a portion of a column of conductive elements. In some embodiments, multiple pairs of signal conductors will be contained within a column in a connector. Accordingly, the structure shown in FIG. 13 may continue in the repeating pattern with additional pairs of signal conductive elements separated by ground conductive elements. This pattern may repeat across the entire column, with each of the signal conductive elements shaped in the interface region like signal conductive elements $\mathbf{1360}_{1A}$ and $\mathbf{1360}_{1B}$ and $\mathbf{1340}_{1A}$ and $\mathbf{1340}_{1B}$. Each of the ground conductive elements may be shaped as ground conductive elements $\mathbf{1350}_1$ and $\mathbf{1350}_2$ and $\mathbf{1330}_1$ and $\mathbf{1330}_2$. Though, as described above, in some embodiments and for some wafers in a connector, a different configuration of ground conductive elements may be employed at either end of a column. For example, as with the embodiments described above in connection with FIGS. 8A, 8B, 9A, 98, 10A, 10B, and 10C, the outer-most ground conductive element in a daughter card connector module may have a planar surface exposed in an exterior side of a front housing. Further, as described in conjunction with FIGS. 4 and 8A, some columns may have no ground conductor on the inner most end of the column.

Figure 14:
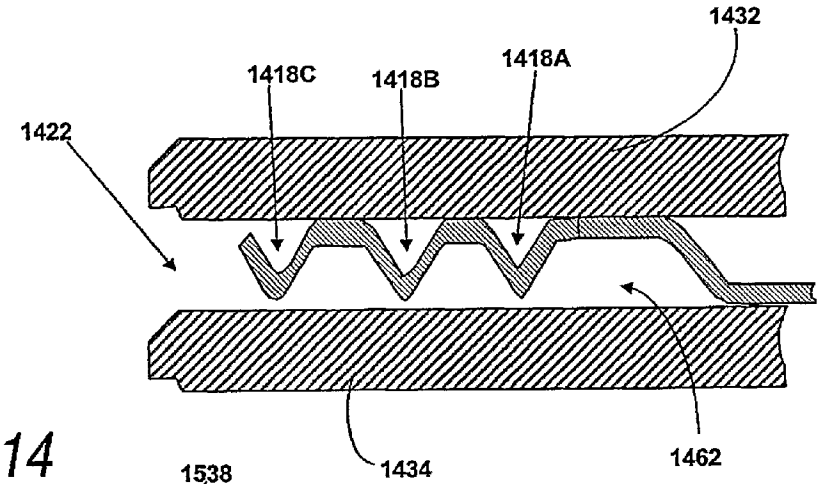
FIG. 14 is a sketch of an alternative embodiment of a wavy mating portion element.
Figure 15:
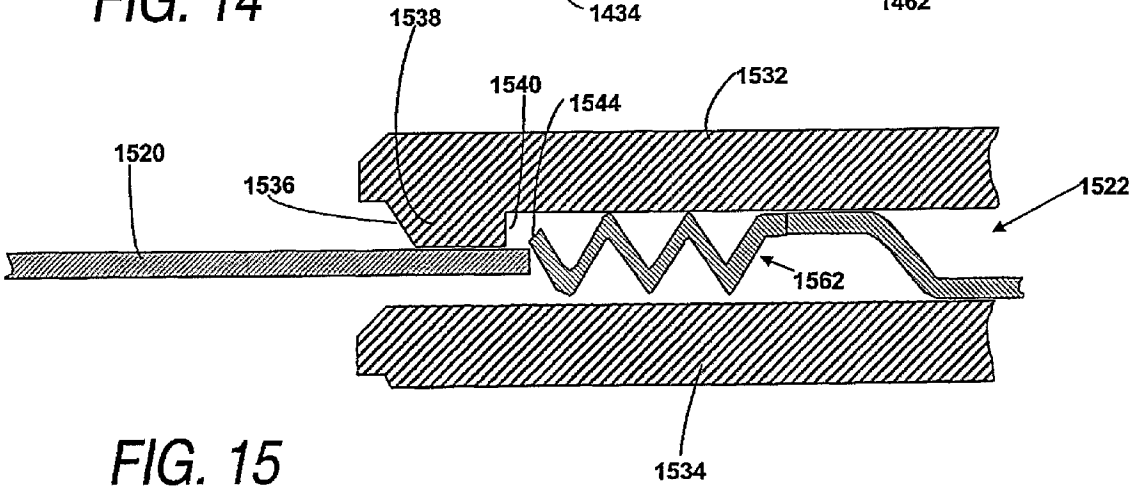
FIG. 15 is a sketch of an alternative embodiment of a connector employing a wavy mating contact portion according to some embodiments of the invention.

FIGS. 14 and 15 illustrate further alternative embodiments of a wavy mating contact. For example, FIG. 14 illustrates that wavy mating contacts need not be symmetrical about an axis parallel to the longitudinal direction of the conductive element. FIG. 14 illustrates a wavy mating contact 1462 that has curved segments 1418A, 1418B and 1418C. These curved segments are shaped such that a greater surface area of wavy mating contact 1462 presses against wall 1432 than faces wall 1434. Alternatively, a wavy mating contact may be constructed with asymmetric features such that a larger surface area presses against a planar mating contact than against a wall of a housing, such as wall 1432.

FIG. 14 illustrates just one possible alternative shape for a wavy contact. As an example of other possible variations, the radius of curvature in each of the curved segments may be greater or less than illustrated. In some embodiments, the radius of curvature may be sufficiently small that the curved segments, such as 1418A, 1418B and 1418C appear as folds in an elongated member rather than gradually curving continuous segments. Variations are also possible in other parameters of the wavy contacts. For example, the number and spacing between curved segments may be varied to increase or decrease the length of wavy mating contact 1462. Likewise the amplitude of wavy segments need not be uniform along the length of the wavy mating contact. For example, it may be desirable to have one or more of the curved segments to have a greater amplitude than others.

FIG. 15 illustrates that variations are also possible in the housing holding wavy contacts according to some embodiments of the invention. FIG. 15 illustrates a wavy mating contact 1562 shaped similarly to the mating contact of FIG. 11. Wavy mating contact 1562 is here positioned within a housing 1522 in which a mating interface with a planar member 1520 from another connector may be formed. In the embodiment of FIG. 15, the housing enclosing cavity 1522 is shaped to facilitate accurate mating between wavy mating contact 1562 and planar member 1520. In the embodiment illustrated, the housing contains a wall 1534 shaped similarly to wall 1434 (FIG. 14). Wall 1532 may be shaped to facilitate mating between wavy mating contact 1562 and planar member 1520 with reduced likelihood of damage of wavy mating contact 1562. As shown, wall 1532, defining one boundary of cavity 1522 has a projection 1638 with a tapered exterior facing surface 1636. Projection 1638 extends into cavity 1522 a sufficient distance that the distal end 1644 of wavy mating contact 1562 is shielded by projection 1638. In this way, the likelihood that planar member 1520 will stub on distal end 1644 is reduced.

The likelihood of stubbing is further reduced by providing distal end 1544 with a taper that will tend to direct planar member 1520 towards wall 1534 as it is inserted into cavity 1522.

Figure 18:
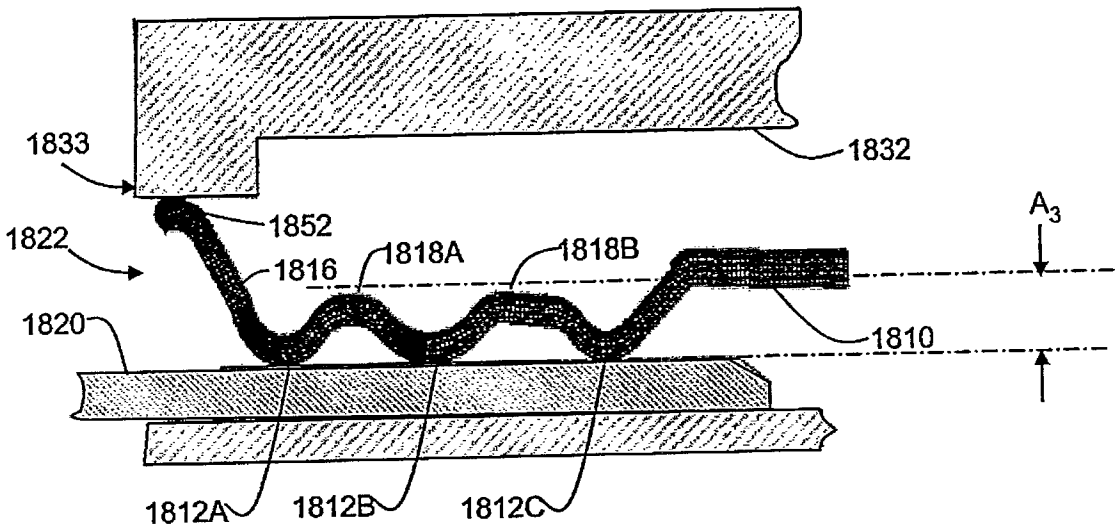
FIG. 18 is a cross-sectional view of a portion of an electrical connector according to a further alternative embodiment of the invention.

In some embodiments, projection 1538 may have a ledge 1540 or other feature that may capture distal end 1544 of wavy mating contact 1562. Such a feature may limit the amount of expansion of wavy mating contact 1562 when mating with planar member 1520. For example, as shown in FIGS. 12A, 12B and 12C, a wavy mating contact may expand from a length $L_1$ in its unmated state to a length $L_3$ in its mated state. This expansion is the result of compression of the wavy mating contact against a wall, such as wall 1532. However, if wall 1532 or other member of a connector includes a feature that limits the amount that wavy mating contact 1562 can elongate, portions of wavy mating contact 1562 may be placed in compression as a result of insertion of planar member 1520 into cavity 1522. This condition may occur if wavy mating contact 1562 lengthens until distal end 1544 abuts surface 1540 on projection 1538. When wavy mating contact 1562 is placed in compression, additional contact force may be generated against planar member 1520. Though, in some embodiments, the connector housing may be formed such that distal end 1544 is not restrained when mated. Such an embodiment is illustrated in FIG. 18. The embodiment of FIG. 18 exhibits less variation in contact force from connector to connector that could arise from tolerances in the positioning of the distal end 1544 relative to surface 1540 and tolerances in manufacturing other features of the connector.

FIGS. 14 and 15 illustrate wavy mating contacts with an amplitude of the wavy portions that is sufficiently large relative to the width of a cavity containing the mating contact portion that a mating contact inserted into the cavity will compress the wavy contact portions. The wavy contact portions illustrated in FIGS. 14 and 15 are illustrated without a curved envelope as illustrated in conjunction with mating contact 1110 (FIG. 12A). However, the wavy mating contacts illustrated in FIGS. 14 and 15 may alternatively be formed with a curved envelope as illustrated in FIG. 12A. Embodiments may be formed of mating contact portions using curved envelope and a wavy contact structure either separately or together to provide a mating contact portion of a conductive element that generates contact force by compression against a side wall of a cavity of a housing.

Figure 16:
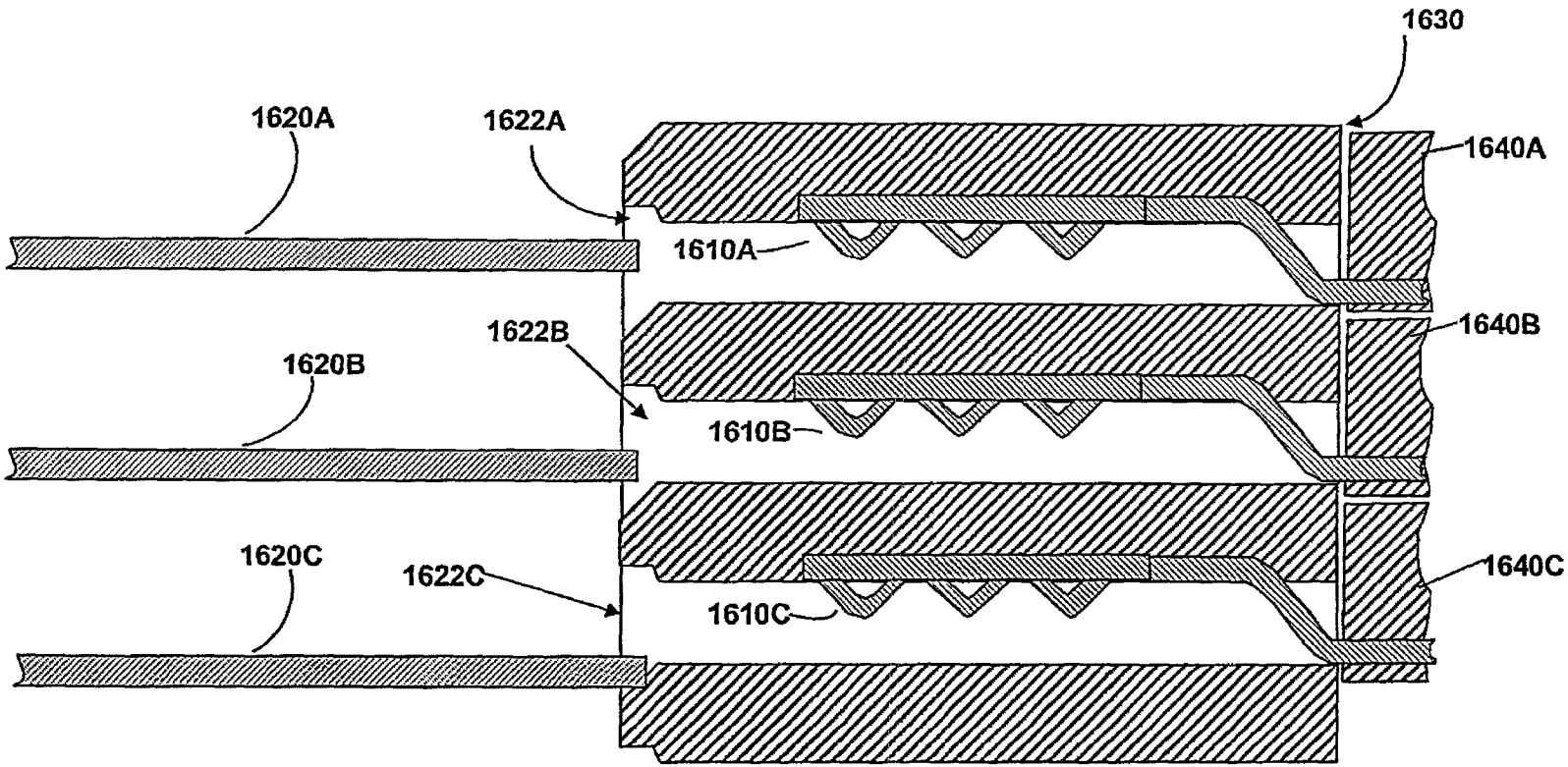
FIG. 16 is a cross-sectional view of a portion of an electrical connector according to an alternative embodiment of the invention.

Moreover, mating contacts of other shapes may be used to provide multiple contact points along a dimension of the mating contact that aligns with direction of relative motion of mating contact pairs during a mating sequence. FIG. 16 illustrates a cross-section of a portion of a connector configured with mating contact portions according to some alternative embodiments. In the embodiment of FIG. 16, the mating contact portions are shaped to provide multiple points of contacts along an elongated dimension of the mating contact portion. In the embodiment of FIG. 16, contact force is also generated by compression of segments of the mating contact portion towards a wall of a housing containing the mating contact portion. As in the above described embodiments, compressive force may be generated as a contact portion, such as contact portions 1320A, 1320B and 1320C, are inserted into cavities, such as 1322A, 1322B and 1322C containing the compressive contacts 1310A, 1310B and 1310C.

FIG. 16 illustrates schematically a cross section through a portion of a mating interface of a connector using such contacts. As shown, the mating interface is positioned within a front housing 1630. Front housing 1630 contains multiple cavities, such as 1622A, 1622B and 1622C. Multiple wafers may be attached to front housing 1630 to form a connector module. Here, portions of wafers 1640A, 1640B and 1640C are shown. As described above in connection with FIGS. 2A and 2B, such wafers may be formed by molding material around a lead frame. Here, the lead frame used to form each wafer may contain a column of conductive elements, each of which has a mating contact portion, as described in greater detail in connection with FIGS. 17A . . . 17C, at one end.

For simplicity, only three mating contacts 1610A, 1610B and 1610C, each part of a different wafer, are shown. In this example, mating contact 1610A and mating contact 1610C may be associated with ground conductors and mating contact 1610B may be associated with a signal conductor. However, each conductive element may be designated to carry signal or reference potential levels to achieve a connector with any desired configuration of conductive elements.

Each of the mating contacts 1610A, 1610B and 1610C is a compressive contact in which contact force is generated by compressing one or more members of the mating contact portion against a housing wall. Such a configuration allows wafers, such as wafers 1640A, 1640B and 1640C, to be spaced on a relatively small pitch. In some embodiments, the spacing, center to center, between wafers, such as 1340A, 1340B and 1340C may be on the order of 1.5 millimeters or less. In some embodiments, the spacing may be approximately 1.35 millimeters or, in other embodiments 1.3 millimeters. Such a spacing may be possible, for example, with a wall thickness, for walls such as 1132 and 1134 (FIG. 11) of approximately 12 mills. Distance $D_1$ may be between approximately 15 and 30 mills. For example, in some embodiments distance $D_1$ is approximately 25 mills.

As can be seen in the schematic representation of FIG. 16, each of the mating contact portions 1610A . . . 1610C provides multiple points of contact along the elongated dimension of the mating contact portion when mated with a complimentary mating contact portion, such as mating contact portion 1620A . . . 1620C. The configuration of FIG. 16 therefore provides the same advantage of reducing the amount of wipe required for reliable mating described above in connection with FIG. 12C.

Figure 17B:
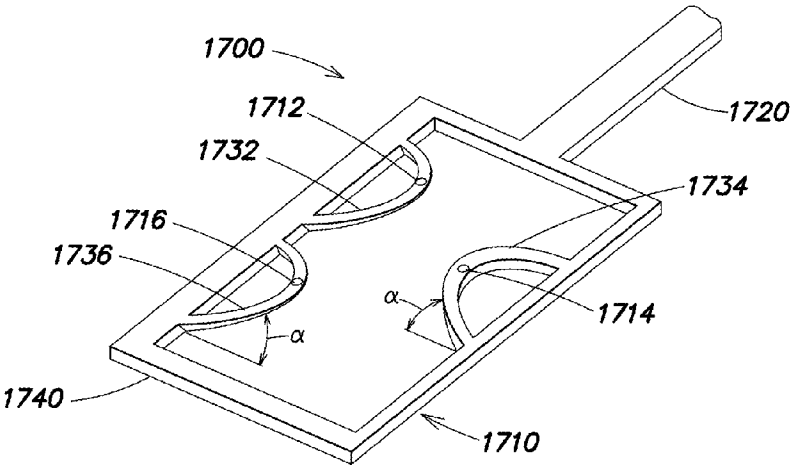
FIG. 17B is a perspective view of the mating contact portion of FIG. 17A.
Figure 17C:
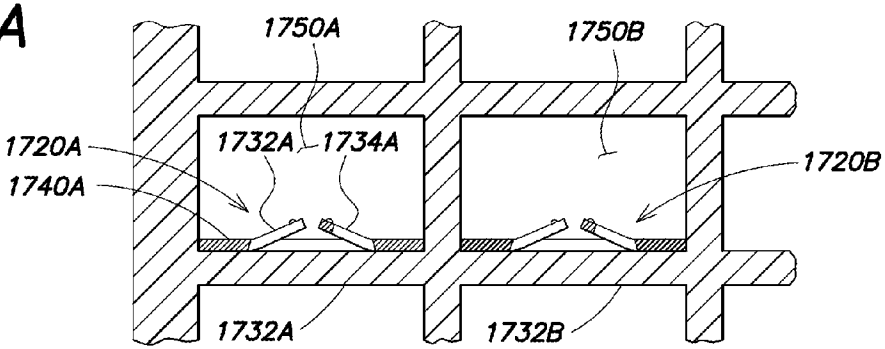
FIG. 17C is a cross-section of an electrical connector containing conductive elements with mating contact portions as in FIGS. 17A and 17B.
Figure 17A:
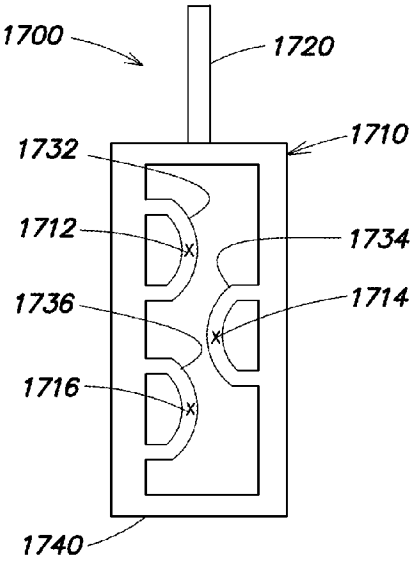
FIG. 17A is a plan view of a mating contact portion of a conductive element according to some embodiments of the invention.

FIGS. 17A, 17B and 17C illustrate an embodiment of a mating contact providing the characteristics illustrated schematically in conjunction with FIG. 16, above.

FIG. 17A illustrates a portion of a conductive element 1700. In the embodiment illustrated, an intermediate portion 1700 and a mating contact portion 1710 are illustrated. Conductive element 1700 may be stamped and formed from a sheet of metal, using materials and techniques as described above in connection with the lead frames of FIGS. 4A and 4B. In the example illustrated, mating contact portion 1710 is wider than intermediate portion 1720. Though any suitable relative sizing may be employed.

In the embodiment of FIG. 17A in which three points of contact are provided, mating contact portion 1710 is stamped with three segments 1732, 1734 and 1736 and a generally planar frame 1740. In this example, each of the segments 1732, 1734 and 1736 is semicircular or arch shaped having two ends, both of which are connected to the frame 1740. As illustrated in FIG. 17B, which is an isometric view of conductive element 1700, each of the segments 1732, 1734 and 1736 may be bent out of the plane of mating contact portion 1710. FIG. 17B illustrates that segments 1732, 1734 and 1736 is each bent upwards at an angle $\alpha$.

By bending segment 1732, 1734 and 1736, multiple contact regions are formed on mating contact portion 1710. Each mating contact region may be formed on a segment, such as segments 1732, 1734 and 1736, at the point of maximum deflection of that segment. Because each of the segments 1732, 1734 and 1736 is connected to frame 1740 at each end, the point of maximum deflection is also an inflection point in the segment.

Each mating contact region may be shaped, coated or otherwise altered to facilitate good electrical contact with a contact portion in the mating conductive element. In the example of FIG. 17B, each mating contact portion includes a dimple, 1712, 1714 and 1716. Alternatively or additionally, each mating contact region may be coated with gold or other material that resists oxidation.

In the example of FIGS. 17A and 17B, the contact regions are spaced different distances from a distal end 1742 of the mating contact portion in the same way that the contact regions are spaced from a distal end in the embodiment of FIG. 11. In the embodiment of FIGS. 17A and 17B, the contact regions are not shown to be collinear. However, it should be appreciated that, in some embodiments, the contact regions may be made collinear along a line corresponding to the direction of relative motion of mating contact portions during a mating sequence by changing the size of the segments 1732, 1734 and 1736.

Turning to FIG. 17C, a portion of an electrical connector employing conductive elements with mating contacts as illustrated in FIGS. 17A and 17B is shown. FIG. 17C shows a cross-section through a mating interface of the connector, including multiple conductive elements with mating contact portions as shown in FIGS. 17A and 17B. FIG. 17C shows two such mating contact portions, mating contact portions 1720A and 1720B. For simplicity of illustration, other mating contact portions and other portions of the connector are cut away in the illustration of FIG. 17C.

Each mating contact portion is positioned with a portion, frame 1740A in this example, adjacent a wall of a housing of the connector. Accordingly, FIG. 17C shows frame 1740A adjacent wall 1732A of a cavity 1750A. With this configuration, segments, of which segments 1732A and 1734A are visible in the cross section of FIG. 17C, extend away from cavity wall 1732A into cavity 1750A. A mating contact portion from a mating connector inserted into cavity 1750A may compress segments 1732A and 1734A towards wall 1732A as described above in connection with FIG. 16. The compressive force will generate contact force as described above, providing multiple points of contacts between conductive elements of mating connectors.

Cavities, such as cavity 1750A and 1750B may be shaped to receive mating contact portions from a conductive element of a mating connector that are generally planar or blade shaped as illustrated above in connection with FIGS. 12A, 12B, 12C and 13. However, any suitable shape may be used.

Having thus described several aspects of at least one embodiment of this invention, it is to be appreciated various alterations, modifications, and improvements will readily occur to those skilled in the art.

For example, FIG. 18 illustrates an embodiment of a wavy mating contact portion in which only a portion of the mating contact portion presses against a wall of a connector housing in the mated configuration. As can be seen, the wavy portion of contact 1810 has an amplitude indicated as $A_3$. Distal end 1852 is positioned at the end of elongated segment 1816, which has a length greater than amplitude $A_3$.

This arrangement creates a region containing curved segments, with inflection points creating contact points, and an elongated segment 1806 attached to the distal-most curved segment in the region. Though the elongated segment 1816 is at an angle relative to the elongated dimension of mating contact 1810, it has a component of its length in a direction normal to the elongated dimension of mating contact 1810 that exceeds the maximum amplitude $A_3$ of the curved segments.

In this example, distal end 1852 of mating contact 1810 extends in a direction towards wall 1832 further than inflection points 1818A and 1818B. Accordingly, in the embodiment illustrated, distal end 1852 makes contact with a support 1833 that is a portion of wall 1832. Moreover, the wall is shaped to only restrain motion in one direction (perpendicular to the wall in this example), while allowing the distal end 1852 to slide along the wall in the mating direction of the connector.

In this embodiment, inflection points 1818A and 1818B do not contact wall 1832, even when mating contact 1820 is fully inserted into cavity 1822. Such a configuration may provide less variation, from connector to connector, in contact force. Though, multiple, reliable points of contact are still provided because force, resulting from compression of mating contact 1810 against will 1832 is transmitted from distal end 1852, through elongated segment 1816 to contact points 1812A, 1812R and 1812C.

FIG. 18 illustrates the mated configuration. Though not shown, when unmated distal end 1852 may touch wall 1832 or, in some embodiments, may be separated from wall 1832 and pressed into the wall during mating.

The contact shape of FIG. 18 may be used with other features described above. For example, in the unmated configuration, mating contact 1810 may have a curvature generally as illustrated in FIG. 12A, that causes distal end 1852 to be spaced from wall 1832. Though, in some embodiments, mating contact 1810 may have sufficient curvature that distal end 1852 contacts wall 1832 even in an unmated configuration in which mating contact 1810 is not being compressed against wall 1832.

Also, though not shown in FIG. 18, cavity 1822 may have an opening shaped to guide mating contact 1820 into position for mating or to protect distal end 1852 from stubbing. Further, in the embodiment of FIG. 18 distal end 1852 is not constrained and may slide along wall 1832 as a mating contact 1820 is inserted into cavity 1822 to compress mating contact 1810 against wall 1832. In other embodiments, mating contact 1810 may be used with a housing having a ledge, similar to ledge 1540 that limits the range of motion of distal end 1852.

FIG. 18 illustrates that it is not necessary that each of the contact points be formed on a segment with inflection points having the same shape. Also, it is not a requirement that each contact point generate the same contact force. In the embodiment illustrated, contact points 1812A and 1812B each generates about 40-60 grams of contact force. In contrast, contact point 1812C may be designed for approximately half of that, providing approximately 20-30 gm of contact force.

Figure 19B:
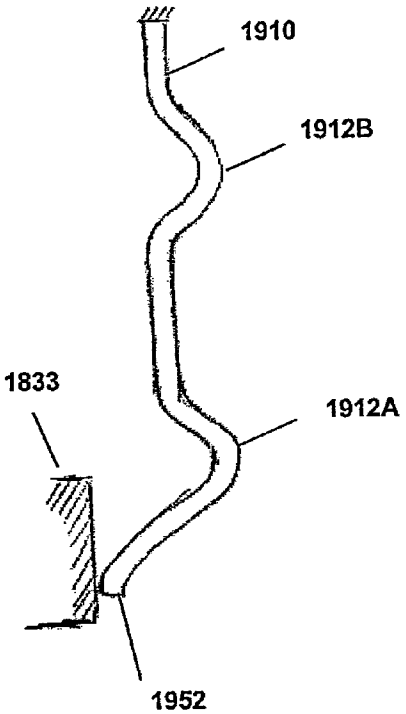
FIG. 19B is a side view of the mating contact portion of FIG. 19A.
Figure 19A:
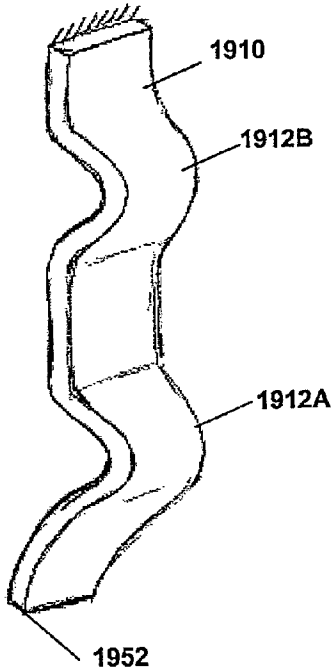
FIG. 19A is a sketch of an alternative embodiment of a mating contact portion.

FIGS. 19A and 19B illustrate a further embodiment of a wavy contact. In this example, mating contact 1910 is shaped as a wave with two peaks. The peaks form contact points 1912A and 1912B. Though two peaks are illustrated in this configuration, it should be appreciated that a mating contact may be formed in a "wavy" configuration with any suitable number of peaks.

In the embodiment of FIG. 19A, mating contact 1910 has an extending distal portion 1952 that is positioned to contact a portion of a wall of a housing into which mating contact 1910 may be supported. In the cross-section of FIG. 19B, distal portion 1952 is shown contacting support 1833, which may be a portion of an insulative wall, such as wall 1832 (FIG. 18).

Figure 20B:
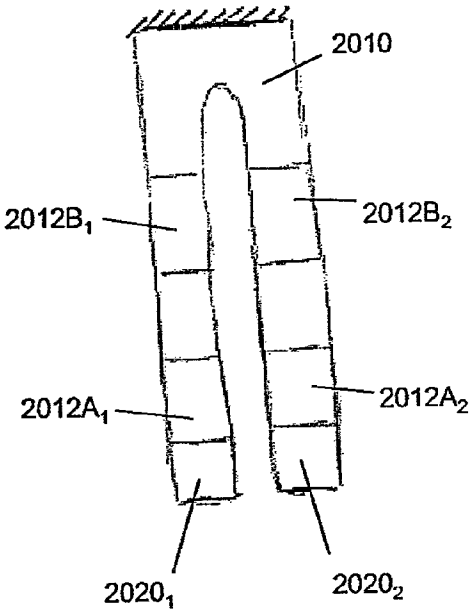
FIG. 20B is a top view of the mating contact portion of FIG. 20A.
Figure 20A:
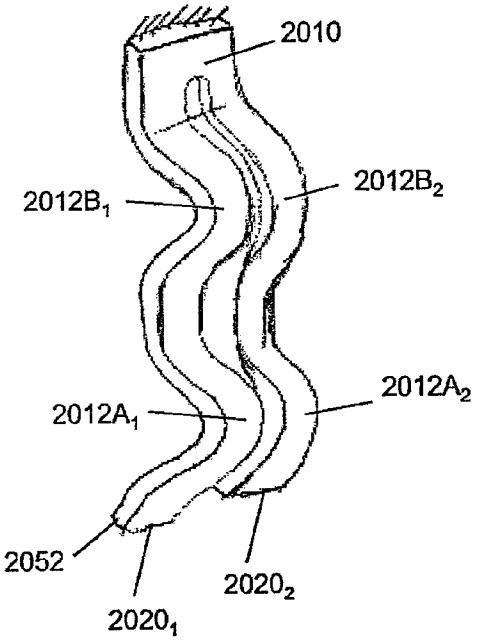
FIG. 20A is a sketch of a further alternative embodiment of a mating contact portion.

FIGS. 20A and 20B illustrate further variations in mating contacts that may be used in a connector. FIG. 20A illustrates mating contacts 2010. In this example, mating contact 2010 is a bifurcated contact, including portions $\mathbf{2020}_1$ and $\mathbf{2020}_2$. Both portions $\mathbf{2020}_1$ and $\mathbf{2020}_2$ may be stamped and formed from the same piece of metal. In this case, each of the portions $\mathbf{2020}_1$ and $\mathbf{2020}_2$ is approximately of the same size and shape. Though, it is not a requirement that both portions be the same or that mating contacts 2010 be symmetric.

In the embodiment illustrated in FIG. 20A, each of the portions $\mathbf{2020}_1$ and $\mathbf{2020}_2$ is shaped as a wave with two peaks, providing a total of four points of contact, $\mathbf{2012}A_1$ and $\mathbf{2012}A_2$, $\mathbf{2012}B_1$ and $\mathbf{2012}B_2$. FIG. 20B is a top view of mating contact 2010, illustrating the relative arrangement of the contact points.

In contrast to the embodiment illustrated in FIG. 19B, mating contacts 2010 is not shown with a distal portion contacting support 1833 or other portion of an insulative side wall 1832. Rather, the distal end 2052 of mating contact 2010 is shown free floating, in a cantilevered configuration. It should be appreciated that a mating contact with any suitable shape may be embodied with multiple inflection points or just a distal end adapted to contact an insulative wall of a connector housing. Alternatively, a mating contact may be used in a cantilevered configuration. In a cantilevered configuration, a spring force generated by deflecting the mating contact may provide a suitable contact force between mating contact portions of mated connectors.

As for other possible variations, examples of techniques for modifying characteristics of an electrical connector were described. These techniques may be used alone or in any suitable combination.

As another example, FIG. 12C illustrates an example in which a mating contact provides a single camming surface 1250 is provided. However, it should be appreciated that depending on the relative size and positions of the segments that make up a contact, multiple camming surfaces may be engaged during a mating sequence.

Further, although many inventive aspects are shown and described with reference to a daughter board connector, it should be appreciated that the present invention is not limited in this regard, as the inventive concepts may be included in other types of electrical connectors, such as backplane connectors, cable connectors, stacking connectors, mezzanine connectors, or chip sockets.

As a further example of possible variations, connectors with four differential signal pairs in a column were described. However, connectors with any desired number of signal conductors may be used.

This invention is not limited in its application to the details of construction and the arrangement of components set forth in the above description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Such alterations, modifications, and improvements are intended to be part of this disclosure, and are intended to be within the spirit and scope of the invention. Accordingly, the foregoing description and drawings are by way of example only.

What is claimed is:

1. A method of operating first and second electrical connectors, the first electrical connector comprising a first plurality of conductive elements disposed in a housing, the second electrical connector comprising a second plurality of conductive elements, wherein:

each of the first plurality of conductive elements has a contact tail, a mating contact portion, and an intermediate portion joining the contact tail and the mating contact portion, the mating contact portion having a first elongated portion and a second elongated portion, the first and second elongated portions being both elongated in a mating direction and being aligned in a direction that is perpendicular to the mating direction, the first elongated portion comprising at least a first curved segment and a second curved segment, the first curved segment being closer to a distal end of the first elongated portion than the second curved segment, the second elongated portion comprising at least a third curved segment disposed offset from, and between, the first and second curved segments in the mating direction;

each of the second plurality of conductive elements has a planar contact; and the method comprises acts of:

a) inserting the planar contacts of the second plurality of conductive elements of the second electrical connector into the housing of the first electrical connector, each planar contact being aligned with the mating contact portion of a corresponding conductive element of the first plurality of conductive elements;

b) sliding the planar contacts along the mating contact portions in the mating direction so that, for at least one first conductive element of the first plurality of conductive elements, a first inflection point of the first curved segment of the first conductive element makes electrical contact with a first contact region of a corresponding second conductive element of the second plurality of conductive elements;

c) continuing sliding the planar contacts along the mating contact portions in the mating direction so that the first inflection point of the first curved segment of the first conductive element reaches a second contact region of the corresponding second conductive element, thereby forming a stub between the second contact region and a distal end of the second conductive element, and a third inflection point of the third curved segment of the first conductive element makes electrical contact with the first contact region of the second conductive element, thereby terminating at least a portion of the stub formed between the second contact region and the distal end of the second conductive element; and d) after c), continuing sliding the planar contacts along the mating contact portions in the mating direction so that a second inflection point of the second curved segment of the first conductive element makes electrical contact with the first contact region of the second conductive element, wherein the mating contact portion of the at least one first conductive element is disposed in a cavity formed in the housing of the first electrical connector, and the first and second contact regions are on a same side of the planar contact of the second conductive element.

2. The method of claim 1, wherein sliding the planar contact of the second conductive element relative to the mating contact portion of the first conductive element along the mating direction compresses the mating contact portion between the planar contact and a wall of the cavity to generate a spring force between the mating contact portion and the planar contact.

3. The method of claim 1, wherein a distance between the first contact region and the distal end of the second conductive element is 1.5 mm or less.

4. The method of claim 1, wherein a distance between the first contact region and the distal end of the second conductive element is 1.1 mm or less.

5. The method of claim 1, wherein a distance between the first contact region and the distal end of the second conductive element is 0.8 mm or less.

6. The method of claim 1, wherein a distance between the first contact region and the distal end of the second conductive element is 0.5 mm or less.

7. The method of claim 1, wherein the first and second inflection points are disposed along a line that is parallel to the mating direction.

8. The method of claim 1, wherein the first and second inflection points are disposed on a same side of, and are offset from, a center line of the mating contact portion, the center line being in the mating direction.

9. The method of claim 8, wherein the third inflection point is disposed on an opposite side of the center line from the first and second inflection points.

10. The method of claim 1, wherein:

the housing comprises a plurality of cavities; and the mating contact portion of each of the first plurality of conductive elements is disposed in a corresponding cavity of the plurality of cavities.

11. The method of claim 10, wherein:

the cavity corresponding to the first conductive element is configured to receive the planar contact of the second conductive element; and sliding the planar contact along the mating direction comprises inserting the planar contact into the cavity.

12. The method of claim 11, where inserting the planar contact into the cavity comprises compressing the first, second, and third curved segments of the first conductive element toward a wall of the cavity.

13. The method of claim 1, wherein:

the first inflection point of the first curved segment comprises a first bump formed on the first curved segment;

the second inflection point of the second curved segment comprises a second bump formed on the second curved segment;

the third inflection point of the third curved segment comprises a third bump formed on the third curved segment; and the first, second, and third bumps are configured to make electrical contact with the second conductive element.

14. The method of claim 13, wherein the first, second, and third bumps are coated with a material that resists oxidation.

15. The method of claim 13, wherein the first, second, and third bumps are coated with gold.

16. A method of operating first and second electrical connectors, the first electrical connector comprising a first plurality of conductive elements disposed in a housing, the second electrical connector comprising a second plurality of conductive elements, wherein:

each of the first plurality of conductive elements has a contact tail, a mating contact portion, and an intermediate portion joining the contact tail and the mating contact portion, the mating contact portion having a first elongated portion and a second elongated portion, the first and second elongated portions being both elongated in a mating direction, the first elongated portion comprising at least a first curved segment and a second curved segment, the first curved segment being closer to a distal end of the first elongated portion than the second curved segment, the second elongated portion comprising at least a third curved segment disposed offset from, and between, the first and second curved segments in the mating direction;

each of the second plurality of conductive elements has a mating contact; and the method comprises acts of:

a) inserting the mating contacts of the second plurality of conductive elements of the second electrical connector into the housing of the first electrical connector, each mating contact being aligned with the mating contact portion of a corresponding conductive element of the first plurality of conductive elements;

b) sliding the mating contacts along the mating contact portions in the mating direction so that, for at least one first conductive element of the first plurality of conductive elements, a first contact surface of the first curved segment of the first conductive element makes electrical contact with a first contact region of a corresponding second conductive element of the second plurality of conductive elements, the first contact region being adjacent to a distal end of the second conductive element;

c) continuing sliding the mating contacts along the mating contact portions in the mating direction so that the first contact surface of the first curved segment of the first conductive element reaches a second contact region of the corresponding second conductive element, the second contact region being further away from the distal end of the second conductive element than the first contact region, thereby forming a stub between the second contact region and the distal end of the second conductive element, and a third contact surface of the third curved segment of the first conductive element makes electrical contact with the first contact region of the second conductive element, thereby terminating at least a portion of the stub formed between the second contact region and the distal end of the second conductive element; and d) after c), continuing sliding the mating contacts along the mating contact portions in the mating direction so that a second contact surface of the second curved segment of the first conductive element makes electrical contact with the first contact region of the second conductive element, wherein the first, second, and third contact surfaces face a same direction, wherein the first and second contact surfaces of the first conductive element are disposed on a same side of, and are offset from, a center line of the mating contact portion, the center line being in the mating direction.

17. The method of claim 16, wherein the first and second contact surfaces of the first conductive element are disposed along a line that is parallel to the mating direction.

18. The method of claim 16, wherein the third contact surface is disposed on an opposite side of the center line from the first and second contact surfaces.

19. The method of claim 16, wherein:

the housing comprises a plurality of cavities; and the mating contact portion of each of the first plurality of conductive elements is disposed in a corresponding cavity of the plurality of cavities.

20. The method of claim 19, wherein:

the cavity corresponding to the first conductive element is configured to receive the mating contact of the second conductive element; and sliding the mating contact along the mating direction comprises inserting the mating contact into the cavity.

21. The method of claim 20, where inserting the mating contact into the cavity comprises compressing the first, second, and third curved segments of the first conductive element toward a wall of the cavity.

22. The method of claim 16, wherein the first, second, and third contact surfaces are coated with a material that resists oxidation.

23. The method of claim 22, wherein the first, second, and third contact surfaces are coated with gold.

24. The method of claim 23, wherein the mating contact of the second conductive element is a planar contact.

* * * * *